US007188918B2

(12) United States Patent
Childers et al.

(10) Patent No.: US 7,188,918 B2
(45) **Date of Patent: *Mar. 13, 2007**

(54) INK DELIVERY SYSTEM ADAPTER

(75) Inventors: Winthrop D. Childers, San Diego, CA (US); Michael L. Bullock, San Diego, CA (US); Eric L. Gasvoda, Salem, OR (US); Norman E. Pawlowski, Jr., Corvallis, OR (US); Ovidiu Talpos, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/634,024

(22) Filed: Aug. 4, 2003

(65) Prior Publication Data

US 2004/0027432 A1 Feb. 12, 2004

Related U.S. Application Data

(63) Continuation of application No. 09/975,295, filed on Oct. 10, 2001, now Pat. No. 6,619,789, which is a continuation-in-part of application No. 09/034,874, filed on Mar. 4, 1998, now Pat. No. 6,130,695, which is a continuation-in-part of application No. 08/785,580, filed on Jan. 21, 1997, now Pat. No. 5,812,156, said application No. 10/634,024 is a continuation-in-part of application No. 08/871,566, filed on Jun. 4, 1997, now Pat. No. 6,074,042.

(51) Int. Cl.
*B41J 2/195* (2006.01)
*B41J 29/393* (2006.01)

(52) U.S. Cl. ..... 347/7; 347/19

(58) Field of Classification Search ..... 347/7, 347/19, 50, 85–87; 141/2, 330; 439/67, 439/492
See application file for complete search history.

(56) References Cited

U.S. PATENT DOCUMENTS

| | | | |
|---|---|---|---|
| 3,371,350 | A | 2/1968 | Sanderson et al. |
| 3,950,761 | A | 4/1976 | Kashio |
| 4,144,756 | A | 3/1979 | Linder |
| 4,183,031 | A | 1/1980 | Kyser et al. |
| 4,422,084 | A | 12/1983 | Saito |
| 4,432,005 | A | 2/1984 | Duffield et al. |
| 4,551,734 | A | 11/1985 | Causley et al. |
| 4,558,326 | A | 12/1985 | Kimura et al. |
| 4,568,954 | A | 2/1986 | Rosback |
| 4,604,633 | A | 8/1986 | Kimura et al. |
| 4,629,164 | A | 12/1986 | Sommerville |

(Continued)

FOREIGN PATENT DOCUMENTS

| | | |
|---|---|---|
| DE | 3043810 | 6/1982 |

(Continued)

*Primary Examiner*—Anh T. N. Vo

(57) ABSTRACT

A large variety of ink delivery systems for an existing ink-jet printing system are provided. The ink delivery systems include ink reservoirs of varying configuration and size which are capable of accommodating a variety of ink use rates. Each ink delivery system also has an electrical connector and an information storage device which are suitable for the various ink use rates. The information storage device may be a memory device circuit that provides enabling information to the printing system.

12 Claims, 16 Drawing Sheets

U.S. PATENT DOCUMENTS

| | | | | | |
|---|---|---|---|---|---|
| 4,714,937 | A | | 12/1987 | Kaplinsky | |
| 4,977,413 | A | | 12/1990 | Yamanaka et al. | |
| 5,049,898 | A | | 9/1991 | Arthur et al. | |
| 5,138,344 | A | | 8/1992 | Ujita | |
| 5,365,312 | A | * | 11/1994 | Hillmann et al. | 399/12 |
| 5,500,664 | A | | 3/1996 | Suzuki et al. | |
| 5,506,611 | A | | 4/1996 | Ujita et al. | |
| 5,561,450 | A | | 10/1996 | Brewster et al. | |
| 5,699,091 | A | | 12/1997 | Bullock et al. | |
| 5,721,576 | A | | 2/1998 | Barinaga | |
| 5,734,401 | A | | 3/1998 | Clark et al. | |
| 5,745,137 | A | | 4/1998 | Pope et al. | |
| 5,757,390 | A | * | 5/1998 | Gragg et al. | 347/7 |
| 5,812,156 | A | * | 9/1998 | Bullock et al. | 347/19 |
| 5,949,459 | A | | 9/1999 | Gasvoda et al. | |
| 5,980,030 | A | * | 11/1999 | Fujii | 347/85 |
| 6,017,118 | A | | 1/2000 | Gasvoda et al. | |
| 6,062,667 | A | * | 5/2000 | Matsui et al. | 347/19 |
| 6,074,042 | A | | 6/2000 | Gasvoda et al. | |
| 6,130,695 | A | | 10/2000 | Childers et al. | |
| 6,318,850 | B1 | | 11/2001 | Childers et al. | |
| 6,322,205 | B1 | | 11/2001 | Childers et al. | |
| 6,619,789 | B2 | * | 9/2003 | Childers et al. | 347/85 |

FOREIGN PATENT DOCUMENTS

| | | | |
|---|---|---|---|
| EP | 0 440 261 | | 8/1991 |
| EP | 0 498 117 | | 8/1992 |
| EP | 0610965 | A1 | 8/1994 |
| EP | 0739740 | A1 | 10/1995 |
| EP | 0 789 322 | | 8/1997 |
| EP | 0 812 693 | | 12/1997 |
| EP | 02075897 | | 5/2002 |
| GB | 2 312 283 | | 10/1997 |
| JP | 59-209878 | | 11/1984 |
| JP | 63-43279 | A | 2/1988 |
| JP | 2-198861 | A | 8/1990 |
| JP | 3-67657 | A | 3/1991 |
| JP | 6-64182 | | 8/1992 |
| JP | 5-318760 | | 12/1993 |
| JP | 6064182 | | 3/1994 |
| JP | 7-290717 | A | 11/1995 |
| JP | 8-80618 | A | 3/1996 |
| JP | 8-197749 | A | 8/1996 |
| JP | 8-236228 | A | 9/1996 |
| JP | 10076676 | | 3/1998 |
| WO | 98/0888 | | 8/1998 |

* cited by examiner

INK DELIVERY SYSTEM ADAPTER

This application is a continuation of U.S. patent application Ser. No. 09/975,295, filed Oct. 10, 2001, now U.S. Pat. No. 6,619,789, which is a continuation-in-part of U.S. patent application Ser. No. 09/034,874, filed Mar. 4, 1998, now U.S. Pat. No. 6,130,695, which is a continuation-in-part of U.S. patent application Ser. No. 08/785,580, filed Jan. 21, 1997, now U.S. Pat. No. 5,812,156. This application is also a continuation-in-part of U.S. patent application Ser. No. 08/871,566, filed Jun. 4, 1997, now U.S. Pat. No. 6,074,042. Also, this application is related to commonly assigned U.S. patent application Ser. No. 09/034,875, filed Mar. 4, 1998, now U.S. Pat. No. 6,227,638, and to U.S. patent application Ser. No. 09/230,950, filed Aug. 8, 1998, now U.S. Pat. No. 6,318,850.

TECHNICAL FIELD

This invention relates in general to ink-jet printing systems and, more particularly, to ink-jet printing systems which makes use of an ink supply cartridge that includes a memory device for exchanging information with the ink-jet printing system.

BACKGROUND OF THE DISCLOSURE

One type of prior art ink-jet printing system or printing system has a printhead mounted to a carriage which is moved back and forth over print media, such as paper. As the printhead passes over appropriate locations on the print media, a control system activates the printhead to eject ink drops onto the print media and form desired images and characters. To work properly, such printing systems must have a reliable supply of ink for the printhead.

One category of ink-jet printing system uses an ink supply that is mounted to and moves with the carriage. In some types, the ink supply is replaceable separately from the printhead. In others, the printhead and ink supply together form an integral unit that is replaced as a unit once the ink in the ink supply is depleted.

Another category of printing system, referred to as an "off-axis" printing system, uses ink supplies which are not located on the carriage. One type replenishes the printhead intermittently. The printhead will travel to a stationary reservoir periodically for replenishment. Parent application Ser. No. 09/034,874 to this application entitled "Ink Delivery System Adapter", now U.S. Pat. No. 6,130,695, describes another printing system wherein the printhead is fluidically coupled to a replaceable ink supply or container via a conduit such as a flexible tube. This allows the printhead to be continuously replenished during a printing operation.

In a parent application to this application, a replaceable off-axis ink supply is described which has a memory device mounted to the housing. When installed into the printing system, an electrical connection between the printing system and the memory device is established. This electrical connection allows for the exchange of information between the printing system electronics and the memory. The memory device stores information which is utilized by the printing system electronics to ensure high print quality. This information is provided to the printing system electronics automatically when the cartridge is mounted to the printing system. The exchange of information assures compatibility of the cartridge with the printing system.

The stored information further prevents the use of the ink supply after it is depleted of ink. Operating a printing system when the reservoir has been depleted of ink can destroy the printhead. The memory devices concerned with this application are updated with data concerning the amount of ink left in the reservoir as it is being used. When a new cartridge is installed, the printing system will read information from the memory device indicative of the reservoir volume. During usage, the printing system estimates ink usage and updates the memory device to indicate how much ink is left in the cartridge. When the ink is substantially depleted, this type of memory device can store data indicative of an out-of-ink condition. When substantially depleted of ink, these cartridges are typically discarded and a new cartridge along with a new memory device is installed.

Previously used ink containers have fixed volumes of deliverable ink that have been provided for printing systems based generally on ink usage rate requirements of a particular user. However, printing systems users have a wide variety of ink usage rates which may change over time. For ink-jet printing system users who require relatively high ink usage rates, ink containers having these volumes require a relatively high ink container replacement rate. This can be especially disruptive for print jobs which are left to run overnight. Extended continuous use of printing systems causes ink containers to run out of ink during a print job. If the printing system does not shut down during an "ink out" condition, the printhead or the printing system itself may be permanently damaged.

For printing system users who require lower volumes of ink, a different set of problems is encountered if the ink volume is too large. The ink may surpass its shelf life prior to being utilized. Larger ink containers are more expensive and bulkier than smaller cartridges and may be cost prohibitive to small volume users. Thus, a need exists for providing adaptive ink supplies for the ink cartridge described in the parent application, so that ink containers having a variety of ink volumes may be utilized. The adaptive ink supplies should be still able to provide to the printing system the benefits of the memory device of the original equipment ink cartridge.

DISCLOSURE OF THE INVENTION

Multiple embodiments of an adaptive ink delivery system for an existing ink-jet printing system are provided. The adaptive ink delivery systems include ink reservoirs of varying configuration and size that are capable of accommodating a variety of ink use rates. Each adaptive ink delivery system also has an electrical connector and an information storage device which are suitable for the various ink use rates. The information storage device may be an emulation circuit that provides enabling information to the printing system regardless of the actual condition of the ink reservoir. The adaptive ink delivery systems allow one to locate the ink reservoir and/or the information storage device remotely from the printing system.

BEST MODE FOR CARRYING OUT THE INVENTION

Although the present invention comprises adapters and methods for altering the volume of ink and the corresponding informational requirements supplied to a printing system, the invention may be more clearly understood with a thorough discussion of the printing system and original equipment ink container.

Figure 1:
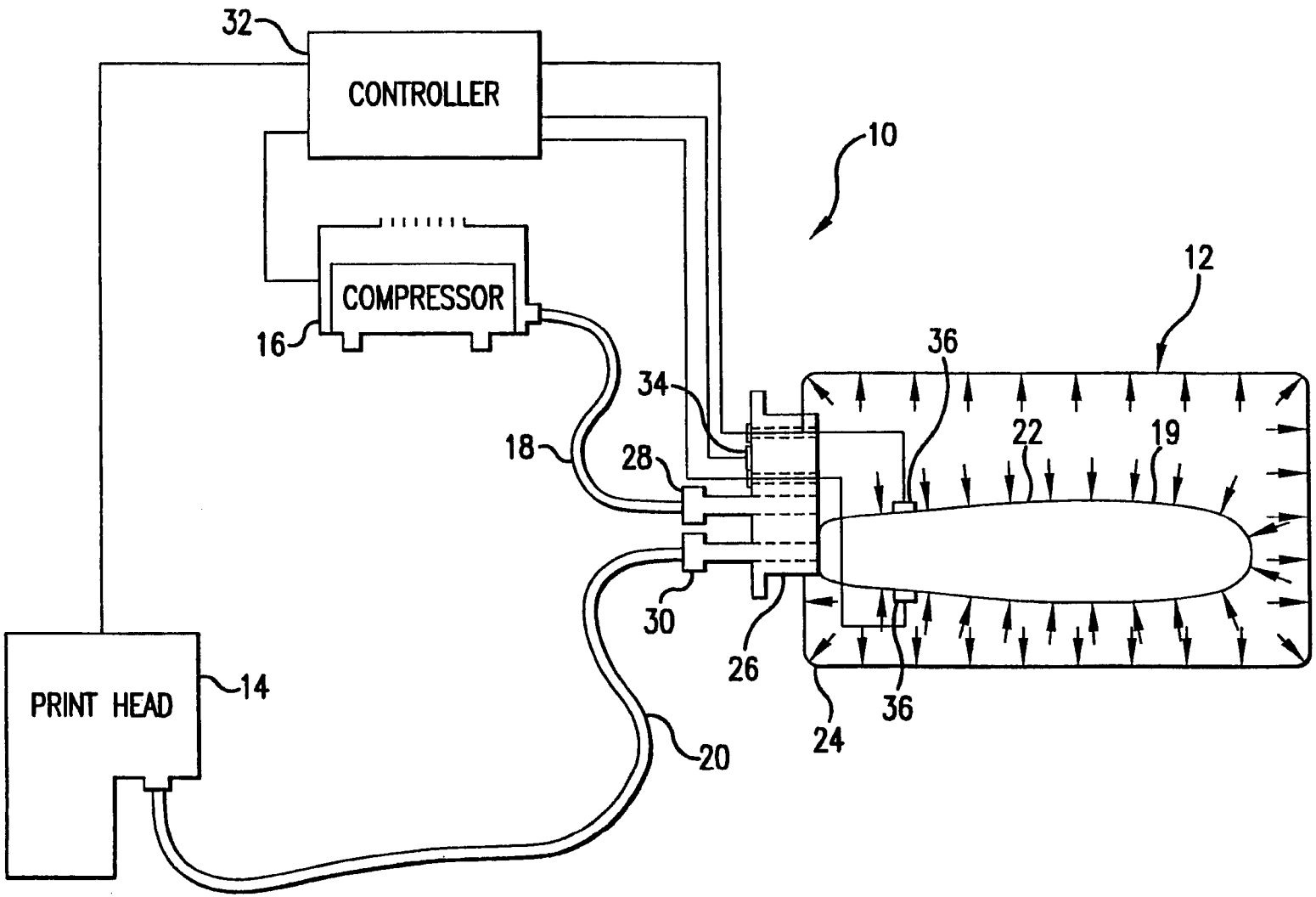
FIG. 1 is a schematic drawing of a printing system having an original equipment ink delivery system.

Referring to FIG. 1, a printing system 10 having an ink container 12, a printhead 14 and a source of pressurized gas, such as a compressor 16, is shown. Compressor 16 is connected to ink container 12 with a conduit 18. A marking fluid 19 such as ink is provided by ink container 12 to printhead 14 by a conduit 20. Ink container 12 includes a fluid reservoir 22 for containing ink 19, an outer shell 24, and a chassis 26. In the preferred embodiment, chassis 26 includes air inlet 28 configured for connection to conduit 18 for pressurizing the outer shell 24 with air. A fluid outlet 30 is also included in the chassis 26. The fluid outlet 30 is configured for connection to the conduit 20 for providing a connection between the fluid reservoir 22 and fluid conduit 20.

In the preferred embodiment, the fluid reservoir 22 is formed from a flexible material such that pressurization of outer shell 24 produces a pressurized flow of ink from the fluid reservoir 22 through the conduit 20 to the printhead 14. The use of a pressurized source of ink in the fluid reservoir 22 allows for a relatively high fluid flow rate from the fluid reservoir 22 to the printhead 14. The use of high flow rates or high rates of ink delivery to the printhead make it possible for high throughput printing by the printing system 10.

The ink container 12 also includes a plurality of electrical contacts, as will be discussed in more detail subsequently. The electrical contacts provide electrical connection between the ink container 12 and printing system control electronics or controller 32. The printing system control electronics 32 control various printing system 10 functions such as, but not limited to, printhead 14 activation to dispense ink and activate pump 16 to pressurize the ink container 12. Ink container 12 includes an information storage device 34 and ink volume sensing circuitry 36. In a preferred embodiment, ink volume sensing circuitry 36 includes two circuits 36 as will be described in more detail with respect to FIGS. 12 and 13. The information storage device 34 provides information to the printing system control electronics 32 such as ink container 12 volume and ink characteristics. The ink volume sensing circuitry 36 provides signals relating to current ink volume in ink container 12 to the printing system control electronics 32.

Figure 2:
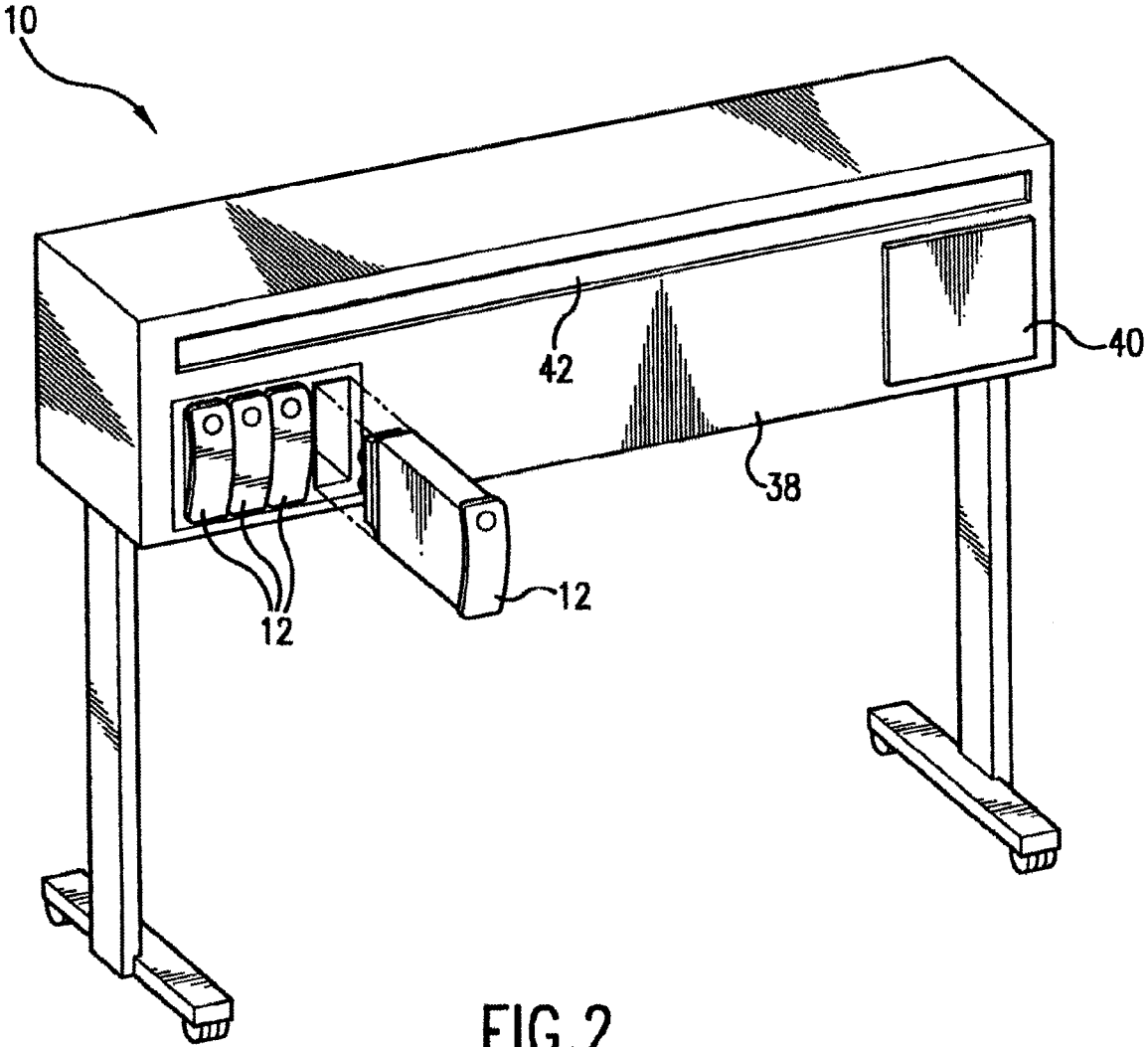
FIG. 2 is an isometric view of a printing system utilizing the printing system of FIG. 1.

FIG. 2 depicts one embodiment of printing system 10 shown in perspective. Printing system 10 includes a printing frame 38 constructed for containing several ink containers 12 simultaneously. The embodiment shown in FIG. 2 has four similar ink containers 12. In this embodiment, each ink container contains a different ink color so that four color printing is available including: cyan, yellow, magenta and black ink. Printing system frame 38 has a control panel 40 for controlling operation of printing system 10 and a media slot 42 from which paper is ejected.

Referring also to FIG. 1, as ink 19 in each ink container 12 is exhausted, container 12 is replaced with a new ink container 12 containing a new supply of ink. In addition, ink containers 12 may be removed from the printing system frame 38 for reasons other than an out of ink condition such as changing inks for an application requiring different ink properties or for use on different media. It is important that the replacement ink container 12 form reliable fluidic and electronic connections with the printing system frame 38 so that printing system 10 performs reliably.

Figure 3:
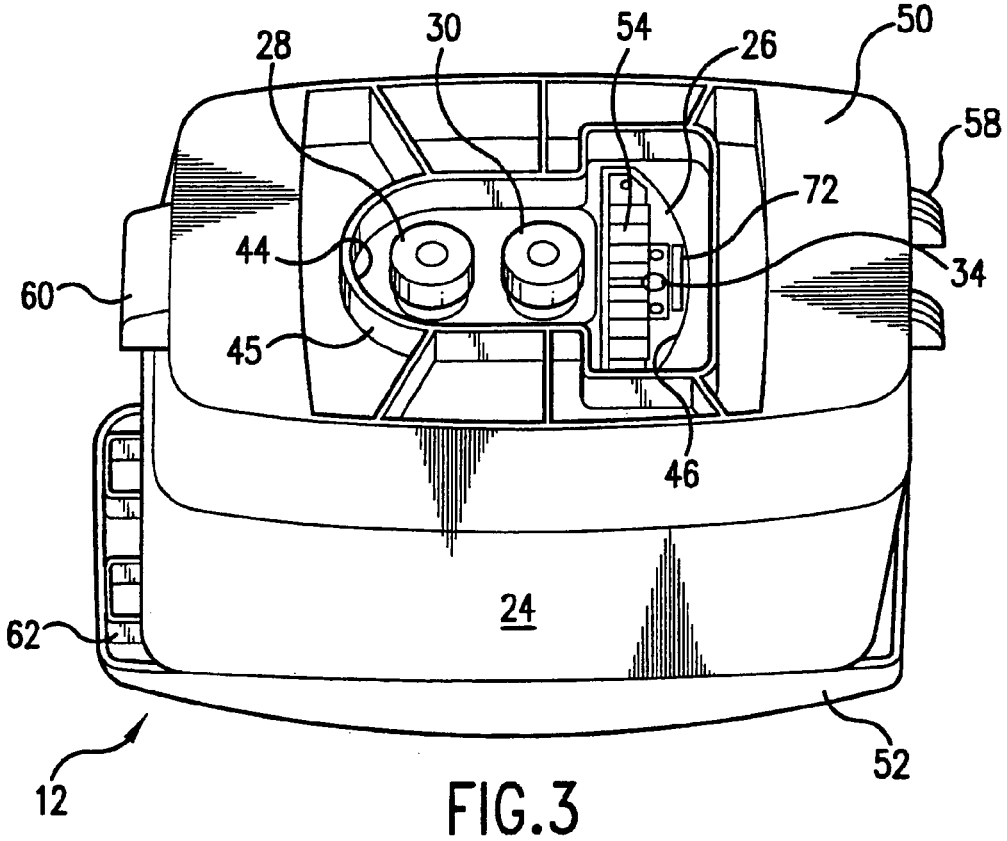
FIG. 3 is an end isometric view of an ink container of the printing system of FIG. 1.
Figure 4:
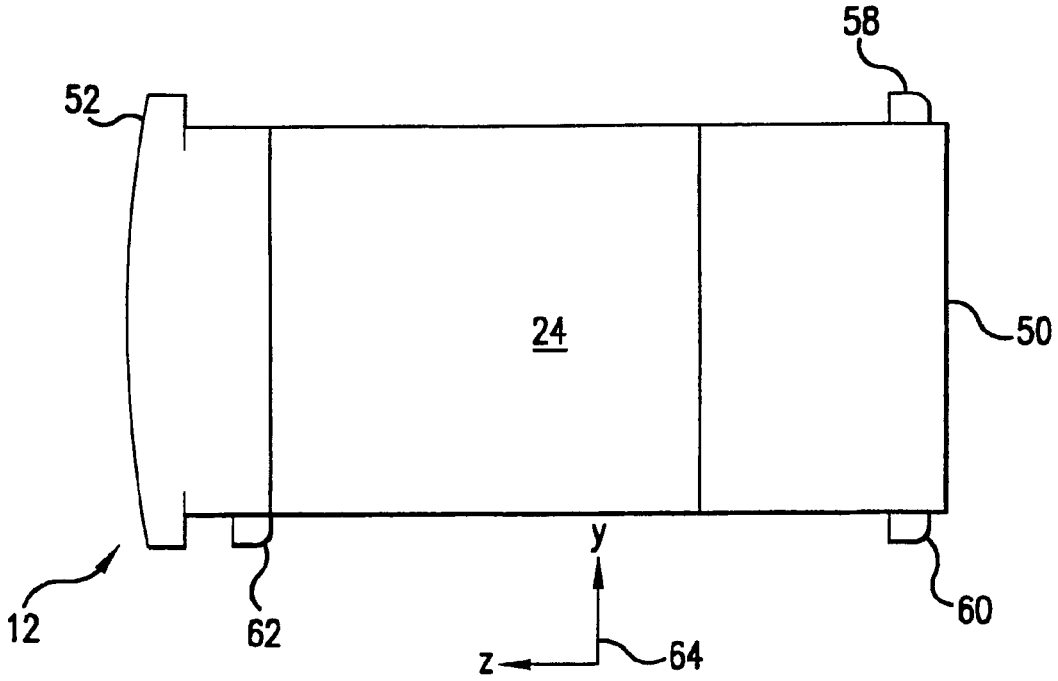
FIG. 4 is a side view of the ink container of FIG. 3.

FIGS. 3 and 4 depict an original equipment ink container 12 having an outer shell 24 which contains the fluid reservoir 22 (FIG. 1) for containing ink 19. Outer shell 24 has a leading cap 50 secured on a leading end and a trailing cap 52 secured on a trailing end, relative to a direction of insertion for the ink container 12 into the printing system frame 38. Leading cap 50 has an aperture 44 on its leading end through which air inlet 28 and fluid outlet 30 from reservoir 22 (FIG. 1) protrude. Reservoir chassis 26 has an end or base which abuts leading cap 50 that air inlet 28 and fluid outlet 30 protrude through aperture 44. Aperture 44 is surrounded by a wall 45, placing aperture 44 within a recess. Air inlet 28 and fluid outlet 30 are configured for connection to compressor 16 and printhead 14, respectively, (FIG. 1) once ink container 12 is properly inserted into the printing system frame 38. Air inlet 28 and fluid outlet 30 will be discussed in more detail subsequently.

Leading cap 50 also has another aperture 46 which is located within the recess defined by a wall 45. The base or end of chassis 26 is also exposed to aperture 46. A plurality of flat electrical contact pads 54 are disposed on reservoir chassis 26 and positioned within aperture 46 for providing electrical connection between circuitry associated with the ink container 12 and printing system control electronics 32. Contact pads 54 are rectangular and located in a straight row. Four of the contact pads 54 are electrically connected to information storage device 34 and four are electrically interconnected to ink volume sensing circuitry 36 as discussed with respect to FIG. 1. In a preferred embodiment, information storage device 34 is a semiconductor memory device and the ink volume sensing circuitry 36 comprises an inductive sensing device. Wall 45 helps protect information storage device 34 and contact pads 54 from mechanical damage. In addition, wall 45 helps minimize inadvertent finger contact with contact pads 54. Contact pads 54 will be discussed in more detail with respect to FIG. 5.

In a preferred embodiment, ink container 12 includes one or more keying and guiding features 58 and 60 disposed on opposite sides of leading cap 50 of container 12. Keying and guiding features 58 and 60 protrude outward from sides of container 12 to work in conjunction with corresponding keying and guiding features on the printing system frame 38 (FIG. 2) to assist in aligning and guiding the ink container 12 during insertion of the ink container 12 into the printing system frame 38. Keying and guiding features 58 and 60 also provide a keying function to insure that ink containers 12 having proper ink parameters, such as proper color and ink type, are inserted into a given slot printing system frame 38.

A latch feature 62 is provided on one side of trailing cap 52. Latch feature 62 works in conjunction with corresponding latching portions on the printing system. portion to secure the ink container 12 within the printing system frame 38 so that interconnects such as pressurized air, fluidic and electrical are accomplished in a reliable manner. Latch feature 62 is a molded tang which extends downwardly relative to a gravitational frame of reference. Ink container 12 as shown in FIG. 4 is positioned for insertion into a printing system frame 38 (FIG. 2) along the Z-axis of coordinate system 64. In this orientation gravitational forces on the ink container 12 are along the Y-axis.

Figure 5:
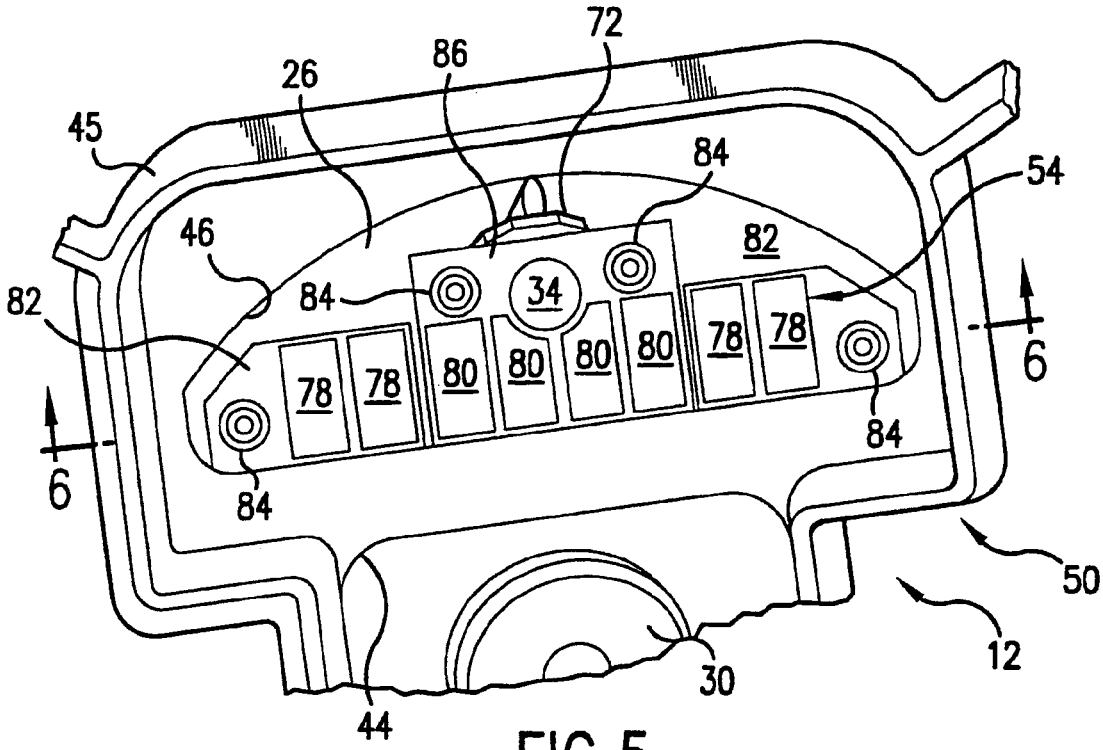
FIG. 5 is a partial enlarged proximal end view of the ink container of FIG. 3.

FIG. 5 depicts an enlarged view of electrical contact pads 54. An upstanding guide member 72 is mounted to chassis 26 adjacent contact pads 54. Electrical contact pads 54 include two pairs of contact pads 78, each pair being electrically connected to one of the volume sensing circuits 36, discussed with respect to FIG. 1. The four contact pads 80 spaced between each pair of pads 78 are electrically connected to the information storage device 34. Each pair of volume sensing contact pads 78 is located on an outer side of the row of contact pads 54. Contact pads 78 are part of a flexible circuit 82 (FIG. 13) which is mounted to the chassis 26 by fasteners 84. The four intermediate contacts 80 located between the pairs of volume sensing contacts 78 are metal conductive layers disposed on a nonconductive substrate 86 such as epoxy and fiberglass. Memory device 34 is also mounted on substrate 86 and is connected by conductive traces (not shown) formed in substrate 86. Memory device 34 is shown encapsulated by a protective coating such as epoxy. A backside of substrate 86, opposite contacts 80, is bonded by adhesive or attached to the chassis 26 by fasteners 84.

Figure 6:
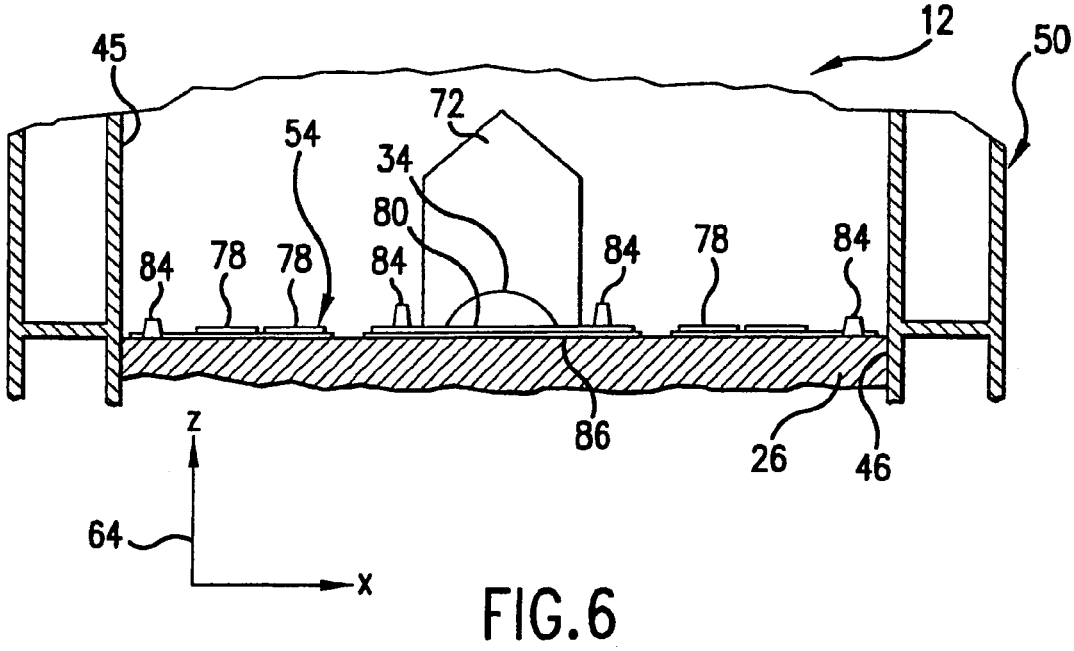
FIG. 6 is a sectional side view of the ink container of FIG. 3 taken along the line 6—6 of FIG. 5.

It can be seen from FIG. 6 that the guide member 72 extends along a Z-axis in coordinate system 64. Guide member 72 has a pointed, tapered distal end. Guide member 72 provides an important guiding function to insure proper electrical connection is accomplished during the insertion of ink container 12 into the printing system frame 38.

Figure 7:
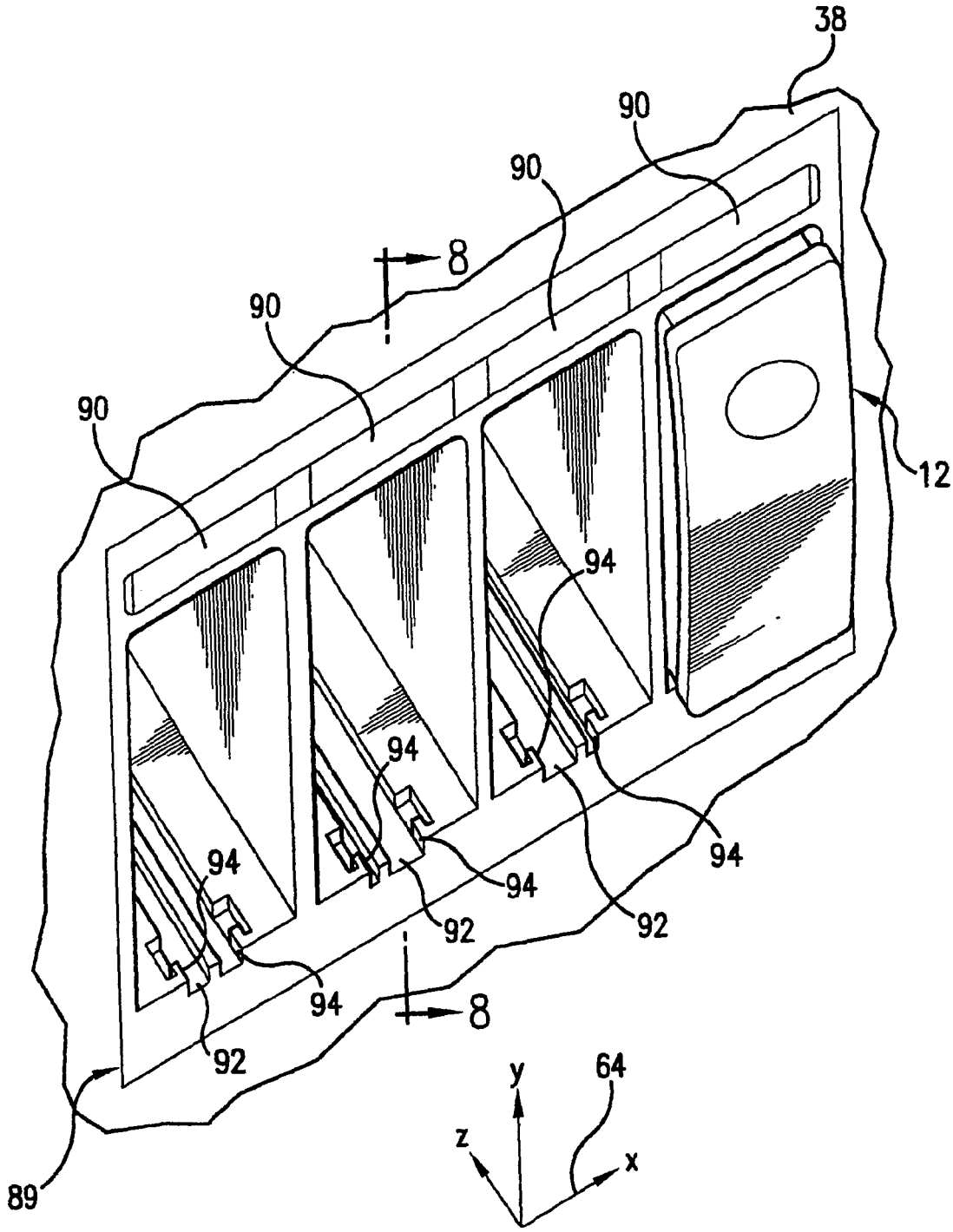
FIG. 7 is a partial enlarged isometric view of a portion of the printing system of FIG. 2, showing the ink container receptacles.

FIG. 7 depicts one ink container 12 shown secured within an ink container receptacle or receiving slot 88 of receiving station 89 within the printing system frame 38. Ink container indicia 90 may be positioned proximate each ink container receptacle 88. The ink container indicia 90 may be a color swatch or text indicating ink color to assist the user in color matching for inserting the ink container 12 in the proper slot 88 within the ink container receiving station 89. As discussed previously, the keying and guiding features 58 and 60 shown in FIGS. 3 and 4 prevent ink containers 12 from being installed in the wrong slot 88. Installation of an ink container 12 in the wrong receptacle 88 can result in improper color mixing or the mixing of inks of different ink types each of which can result in poor print quality.

Each receiving slot 88 within the ink container receiving station 89 includes keying and guiding slots 92 and latching portions 94. Keying and guiding slots 92 cooperate with the keying and guiding feature 60 (FIG. 3) to guide ink container 12 into the ink container receiving station 88. The keying and guiding slot associated with the keying and guiding feature 58 (FIG. 3) on ink container 12 is not shown. Each latching portion 94 is configured for engaging the corresponding latch feature 62 on the ink container 12. The geometries of keying and guiding slots 92 vary from one receptacle 88 to the other to assure that ink containers containing proper colors and ink compositions are only installed in the proper receiving receptacles.

Figure 8:
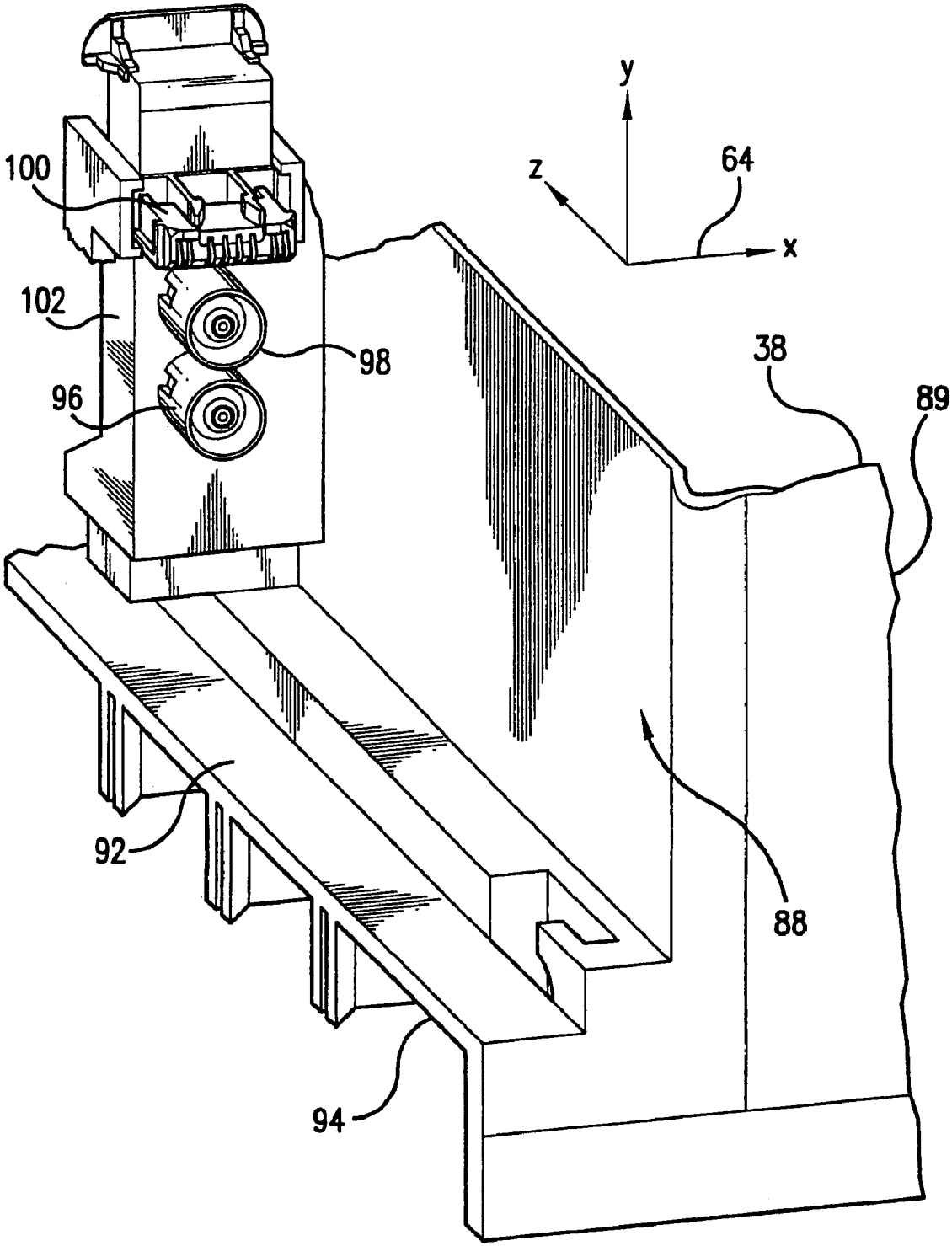
FIG. 8 is an enlarged partial isometric and cut away view of the printing system of FIG. 2 taken along the line 8—8 of FIG. 7.

FIG. 8 shows a single ink container receiving slot 88 within the ink container receiving station 89. Slot 88 includes interconnect portions for interconnecting with the ink container 12. In the preferred embodiment these interconnect portions include a fluid inlet 98, and air outlet 96 and an electrical interconnect portion 100. Each of the interconnects 96, 98, and 100 are positioned on a floating platform 102 which is biased by coil springs 101 (FIG. 10A) along the Z-axis toward the installed ink container 12. Fluid inlet 98 and air outlet 96 are configured for connection with the corresponding fluid outlet 30 and air inlet 28 (FIG. 3), respectively on the ink container 12. The electrical interconnect 100 is configured for engaging electrical contacts 54 on the ink container 12.

It is the interaction between the keying and guiding features 58 and 60 associated with the ink container 12 and the corresponding keying and guiding slots 92 associated with the ink container receiving station 89 which guide the ink container 12 during the insertion such that proper interconnection is accomplished between the ink container 12 and the printing system frame 38. In addition, sidewalls associated with each slot 88 in the ink container receiving station 89 engage outer surfaces of ink container 12 to assist in guiding and aligning ink container 12 during insertion into slot 88.

Figure 9:
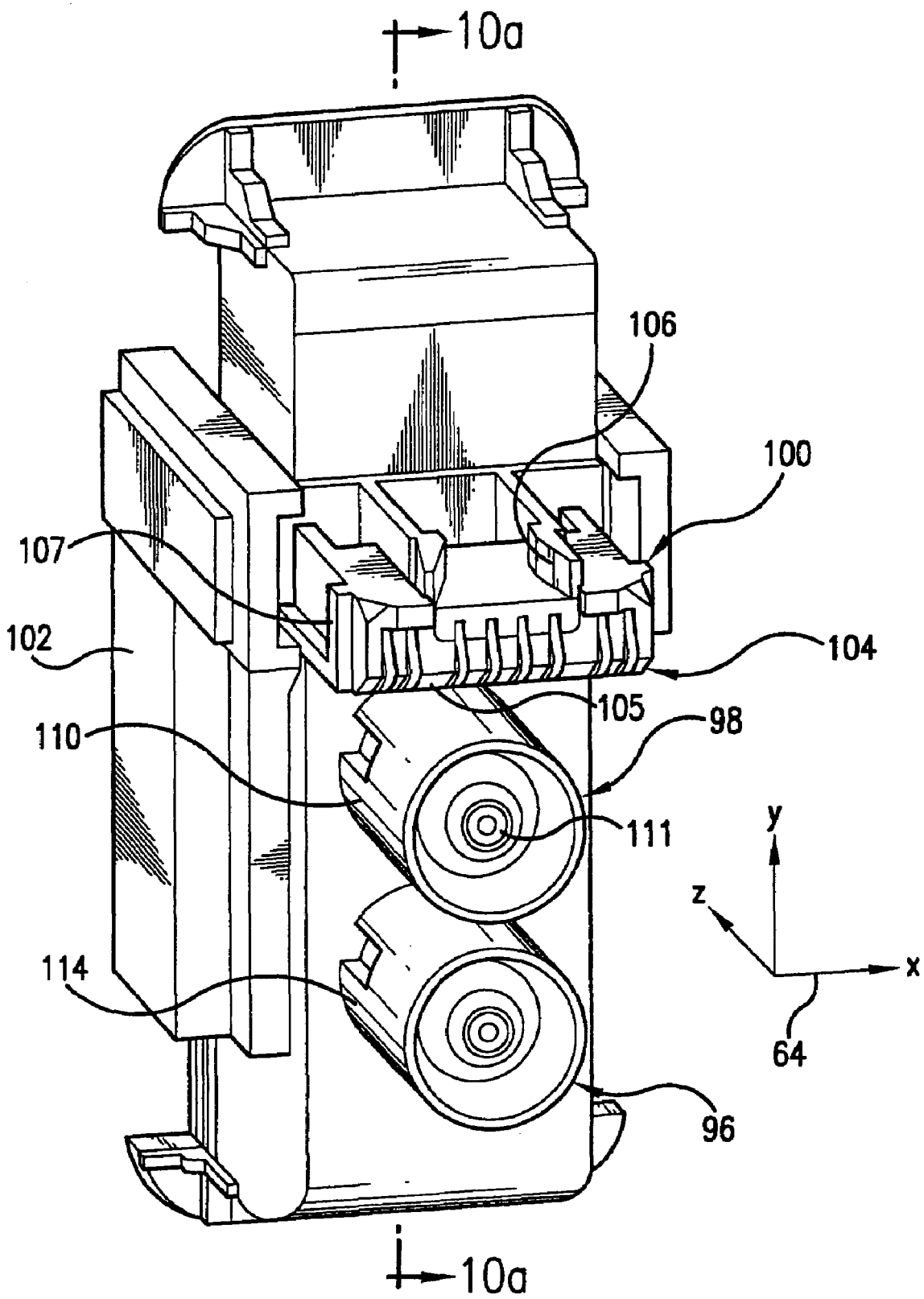
FIG. 9 is an enlarged isometric view of an interface portion of the printing system of FIG. 2.
Figure 10A:
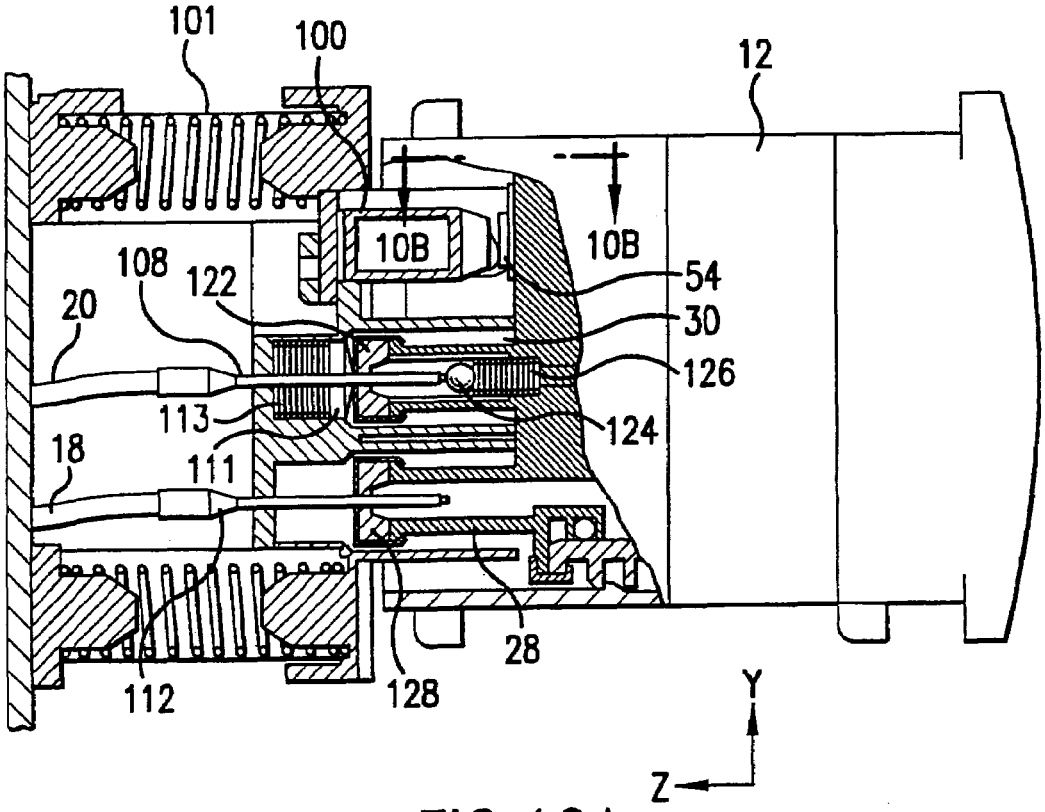
FIG. 10A is a partial sectional view of the interface portion of the printing system which is shown in FIG. 9 taken along the line 10A—10A of FIG. 9 and showing also a partial sectional view of the ink container installed.

FIGS. 9 and 10A illustrates further details of the floating platform 102. Platform 102 is spring biased by coil springs 101 in a direction opposite the direction of insertion of the ink container 12 into the ink container receiving slot 88 (FIG. 10A). Platform 102 is biased towards mechanical restraints (not shown) which limit the motion of platform 102 in each of the X, Y, and Z-axes. Therefore, platform 102 has a limited degree of motion in each of the X, Y, and Z-axes of coordinate system 64.

Figure 10B:
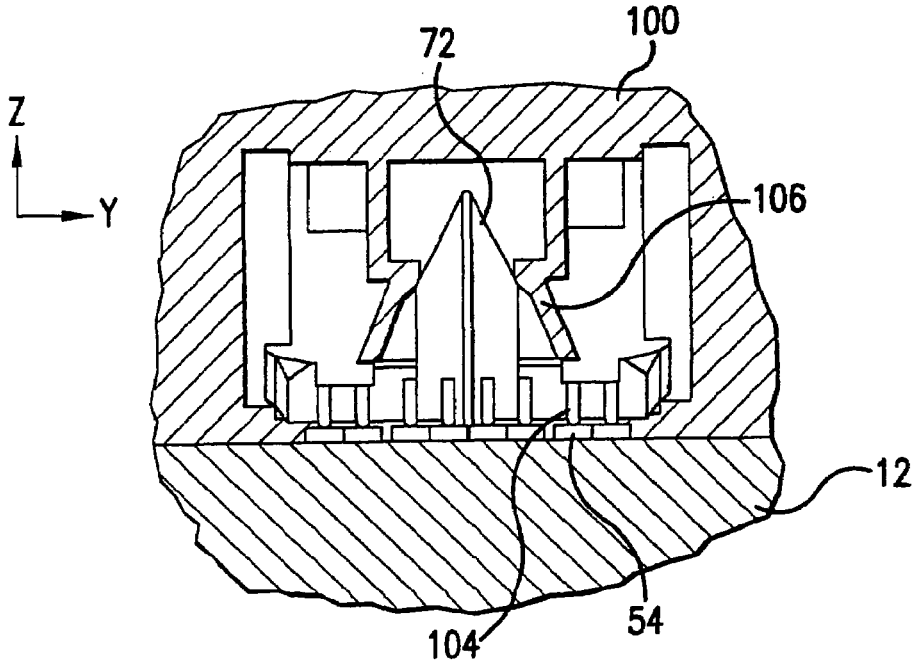
FIG. 10B is an enlarged view of the printing system of FIG. 10A, taken along the line 10B—10B of FIG. 10A.

Electrical connector 100 is supported by and protrudes from platform 102. Electrical connector 100 is generally rectangular, having two lateral sides 107, upper and lower sides, and a distal end 105. A plurality of resilient, spring-biased electrical contacts 104 protrude from end 105. Electrical contacts 104 are thin wire-like members which engage corresponding electrical contacts 54 (FIG. 3) associated with ink container 12 to electrically connect an electronic portion of ink container 12 with the printing system control electronics 32 (FIG. 1). Electrical connector 100 has a guide slot 106 on its upper side. Guide slot 106 has opposed converging walls which cooperate to engage guide member 72 (FIGS. 5 and 10B). Guide member 72 engages guide slot 106 to properly align contacts 104 with contact pads 54. FIG. 10B shows contact pads 54 properly aligned with electrical contacts 104.

Referring to FIGS. 9 and 10A, fluid inlet 98 and air outlet 96 protrude from floating platform 102. Fluid inlet 98 includes an ink supply sleeve 110 surrounding a hollow needle 108. Needle 108 has a port near its distal end. A collar 111 sealingly and slidingly engages needle 108. A spring 113 urges collar 111 toward the distal end, blocking the port. Air outlet 96 includes an air supply sleeve 114 that surrounds a hollow needle 112.

Referring still to FIG. 10A, fluid outlet 30 is an outwardly extending cylindrical member having a septum 122 on its distal end. Septum 122 has a slit for receiving needle 108. In a preferred embodiment, a check valve comprising a ball 124 and spring 126 are located in fluid outlet 30 to prevent outflow of ink until needle 108 is inserted. Ball 124 seats against septum 122 and is pushed away from septum 122 by needle 108. Air inlet 28 is also a cylindrical member having a septum 128 with a slit.

When ink container 12 is releasably inserted into receiving slot 88, keying and guiding features 58 and 60 provide coarse alignment between the ink container and the receiving slot 88, such that the distal end of fluid outlet 30 can properly engage the distal end of ink supply sleeve 110 and such that the distal end of air inlet 28 can properly engage the distal end of air supply sleeve 114. Engagement forces between the distal end of fluid outlet 30 and the ink supply sleeve 110 and between the distal end of air inlet 28 and the air supply sleeve 114 generate a force that causes the floating platform 102 to move into alignment with respect to ink container 12 such that needle 108 can be received by and hence form a fluid connection with fluid outlet 30. This alignment of floating platform 102 also allows needle 112 to be received by and form an air connection with air inlet 28.

When fluid outlet 30 properly engages fluid inlet 98, the distal end of fluid outlet 30 slides collar 111 from a position wherein it seals the port on hollow needle 108 to a position wherein the port on hollow needle 108 is opened. At the same time, the distal end of fluid outlet 30 receives the hollow needle 108 providing fluid communication between the hollow needle 108 and fluid outlet 30. It is important that fluid outlet 30 is sized properly with the distal end having a proper diameter such that it can be received in ink supply sleeve 110 and the fluid outlet having sufficient length such that it will properly depress collar 111 and receive the port on the hollow needle to allow fluid flow from fluid outlet 30 to hollow needle 108.

The fluidic and air connections described above provide an intermediate accuracy of alignment between connector 100 and the plurality of contacts 54 associated with ink container 12. This intermediate accuracy is adequate for electrical connection along the y-axis depicted by axes 64 in FIG. 9. However, this coarse alignment is not accurate enough along the x-axis. Electrical connector 100 is mounted to floating platform 102 such that it has a degree of movement along the x-direction. A fine alignment along the x-direction is then provided by at least one guiding member associated with ink container 12 that engages the connector 100. In a preferred embodiment, the at least one guiding member is upstanding member 72 that engages opposed converging walls of electrical connector 100.

Figure 11B:
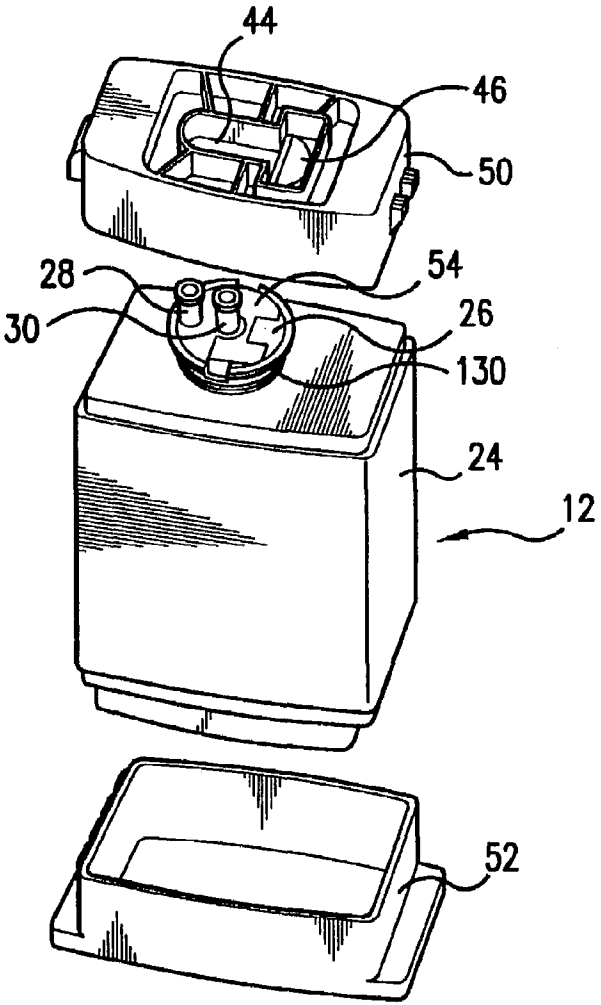
FIG. 11B is a partially exploded isometric view of the ink container of FIGS. 10A, 10B, as shown from the proximal end.
Figure 11A:
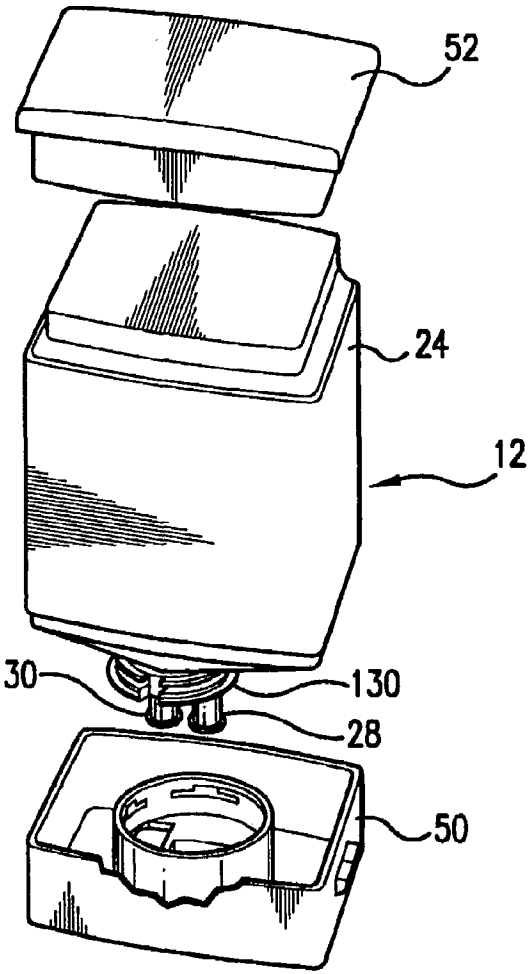
FIG. 11A is a partially exploded isometric view of the ink container of FIGS. 10A, 10B, as shown from the distal end.
Figure 14:
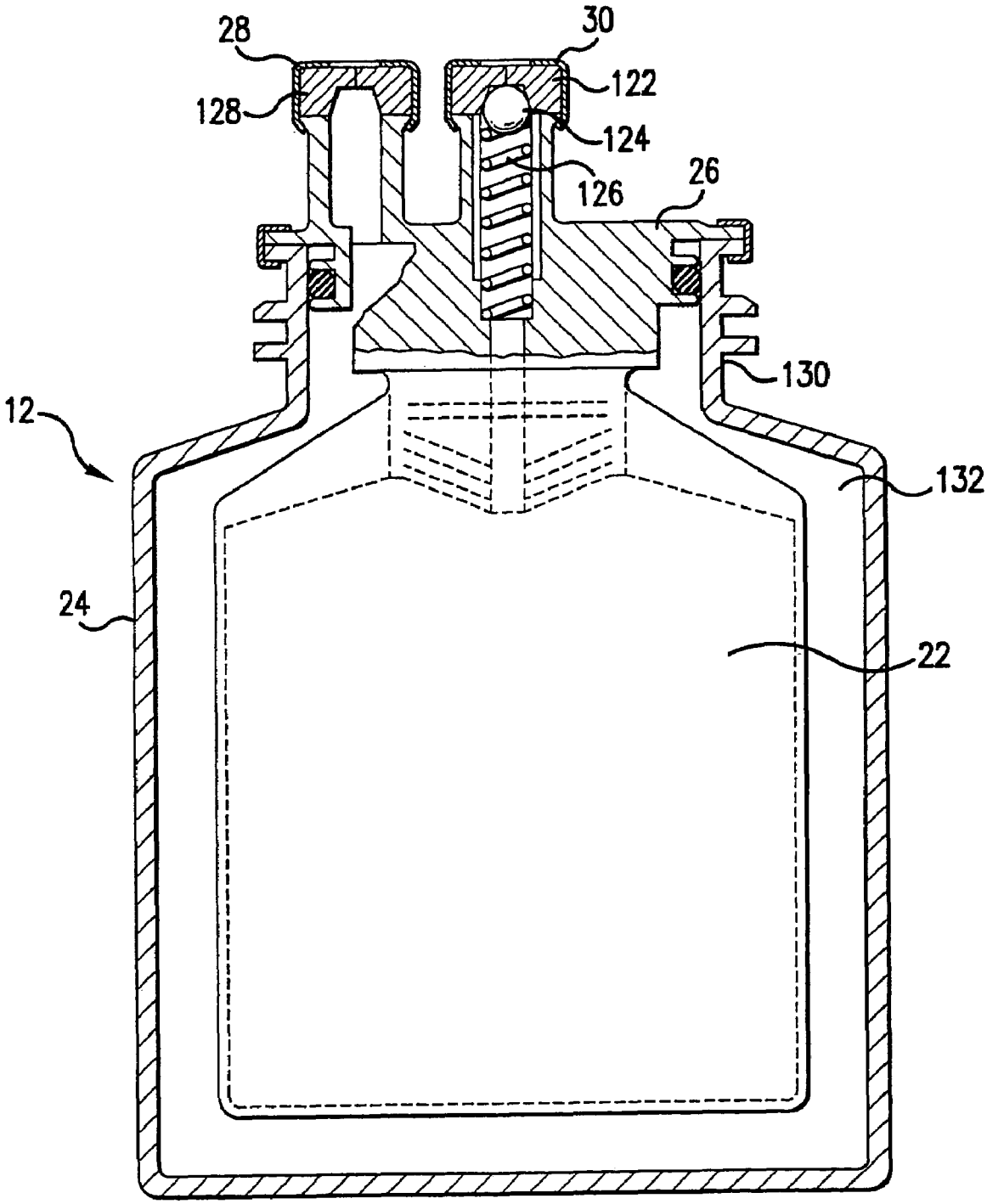
FIG. 14 is a sectional view of the ink container of FIGS. 10A, 10B, with the proximal cap removed.

As shown in FIGS. 11A, 11B and 14, shell 24 is a generally rectangular member with a cylindrical neck 130 on its leading end. Chassis 26 is a circular disk or plug that inserts and seals in neck 130 with the leading side of chassis 26 flush with the rim of neck 130. Reservoir 22 is a collapsible reservoir such as a collapsible bag that fits within shell 24. An opening in reservoir 22 is sealingly joined to chassis 26. Shell 24 is airtight, creating a pressure chamber 132 in the space surrounding reservoir 22. Air inlet 30 leads to pressure chamber 132.

Figure 12:
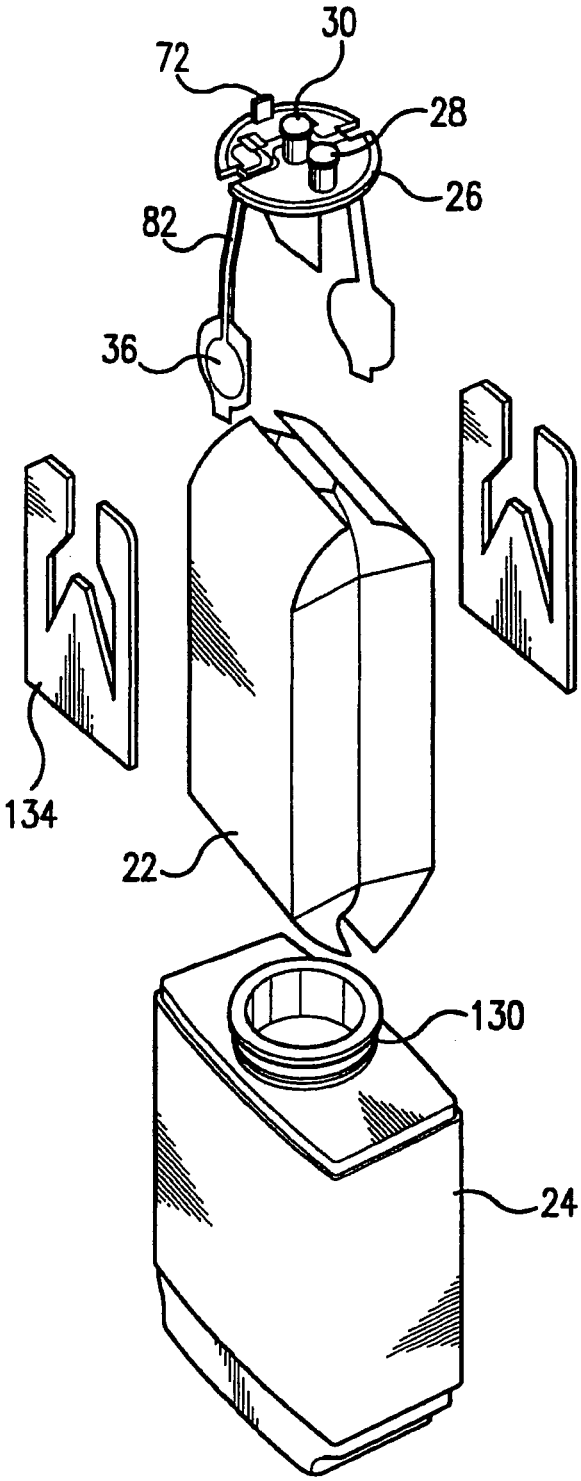
FIG. 12 is a further exploded isometric view of the ink container of FIGS. 10A, 10B.
Figure 13:
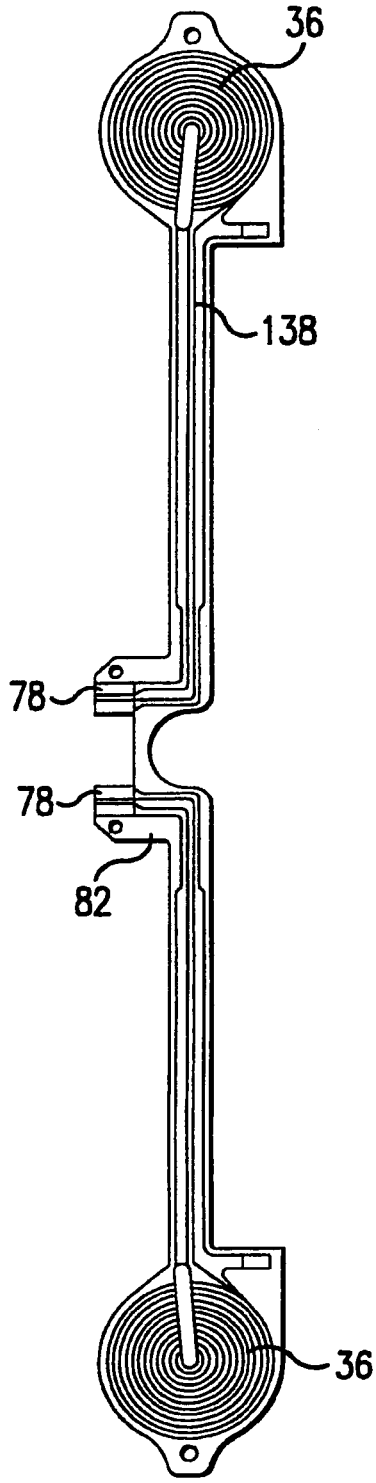
FIG. 13 is an enlarged side view showing the inductive fluid level sensors for the ink container of FIGS. 10A, 10B, shown detached from the ink container.

Referring to FIG. 12, rigid stiffener plates 134 are attached to opposite outer sides of reservoir 22. The two inductive ink volume sensor coils 36 are formed on opposite legs of flexible circuit 82. Each of the coils 36 has two leads 138 (FIG. 13) connected to one of the pairs of sensor contacts 78 (FIG. 3). One of the coils 36 is located on one side of reservoir 22 while the other is on the opposite side. When connected to printing system 10, printing system electronics provide a time varying signal to one of the coils 36. This induces a voltage in the other coil 36 whose magnitude varies as the separation distance between coils 36 varies. As ink is used, the opposing side wall portions of reservoir 22 collapse together, changing the electromagnetic coupling or mutual inductance of the coil pair. This change in coupling is sensed by controller 32, which infers an ink level as a result. Additionally, controller 32 also makes a continuity check when ink container 12 is installed by determining if electrical continuity exists between the two contact pads 78 leading to one of the coils 36.

Each ink container 12 has unique ink container-related aspects that are represented in the form of data provided by information storage device 34. This data is provided from ink container 12 to printing system 10 via memory device 34 automatically without requiring the user to reconfigure printing system 10 for the particular ink container 12 installed. Memory device 34 has a protected section, a write-once section, and a multiple write/erase section. When the cartridge 12 is first installed in printing system 10, controller 32 reads ink container information such as the manufacturer identity, part identification, date code of ink supply, system coefficients, service mode and ink supply size. Printing system 10 energizes one of coils 36 and reads an initial receiving coil voltage from the other (receiving) coil 36. This initial receiving coil voltage from receiving coil 36 is indicative of the full state of ink container 12. The printing system control electronics then record a parameter onto the protected portion of memory device 34 that is indicative of the initial receiving coil voltage. The printing system control electronics then initiate a write protect feature to assure that the information in the protected portion of memory stays the same.

The write once section is a portion of memory which can be written to by controller 32 only one time. The multiple write/erase section can be written to and erased repeatedly. Both of these sections store information concerning current ink quantity. As will be explained below, the coarse bit information is stored in the write once section and the fine bit data is stored in the multiple write/erase section.

Upon insertion of ink container 12 into printing system 10, controller 32 reads information from memory device 34 for controlling various printing functions. For example, controller 32 utilizes information from memory device 34 to compute an estimate of remaining ink. If the ink remaining is less than a low ink threshold volume, a message is provided to the user indicating such. Further, when a substantial portion of the ink below the threshold volume is consumed, controller 32 can disable printing system 10 to prevent operation of printhead 14 without a supply of ink. Operating printhead 14 without ink can result in reduction of printhead reliability or catastrophic failure of printhead 14 In operation, controller 32 reads initial volume information from memory device 34 associated with ink container 12. As ink is used during printing, the ink level is monitored by controller 32, and memory device 34 is updated to contain information relating to remaining ink in ink container 12. Controller 32 thereafter monitors the level of deliverable ink in ink container 12 via memory device 34. In a preferred embodiment, data is transferred between printing system 10 and memory device 34 in serial fashion using a single data line relative to ground.

In a preferred embodiment, the volume information includes the following: (1) initial supply size data in a write protected portion of memory, (2) coarse ink level data stored in write once portion of memory and (3) fine ink level data stored in a write/erase portion of memory. The initial supply size data is indicative of the amount of deliverable ink initially present in ink container 12.

The coarse ink level data includes a number of write once bits that each correspond to some fraction of the deliverable ink initially present in ink container 12. In a first preferred embodiment, eight coarse ink level bits each correspond to one-eighth of the deliverable ink initially in ink container 12. In a second preferred embodiment, to be used in the discussion that follows, seven coarse ink level bits each correspond to one-eighth of the deliverable ink initially present in ink container 12 and one coarse ink level bit corresponds to an out-of-ink condition. However, more or less coarse bits can be used, depending on the accuracy desired for a coarse ink level counter.

The fine ink level data is indicative of a fine bit binary number that is proportional to a fraction of one-eighth of the volume of the deliverable ink initially present in ink container 12. Thus, the entire range of the fine bit binary number is equivalent to one coarse ink level bit as will be explained in more detail below.

Printing system 10 reads the initial supply size data and calculates the amount or volume of deliverable ink initially present in ink container 12. The drop volume ejected by the printhead 14 is determined by printing system 10 by reading parameters and/or performing calculations. Using the initial volume of deliverable ink in ink container 12 and the estimated drop volume of printhead 14, the printing system 10 calculates the fraction of the initial deliverable ink volume that each drop represents. This enables the printing system 10 to monitor the fraction of the initial volume of deliverable ink remaining in ink container 12.

While printing, printing system 10 maintains a drop count equal to the number of ink drops that have been ejected by printhead 14. After printing system 10 has printed a small amount, typically one page, it converts the drop count to a number of increments or decrements of the fine bit binary number. This conversion utilizes the fact that the entire range of the fine bit binary number corresponds to one eighth of the initial volume of deliverable ink in ink container 12. Each time the fine bit binary number is fully decremented or incremented, the printing system 10 writes to one of the coarse ink level bits to "latch down" the bit.

Printing system 10 periodically queries the coarse and fine ink level bits to determine the fraction of the initial deliverable ink that is remaining in ink container 12. Printing system 10 can then provide a "gas gauge" or other indication to a user of printing system 10 that is indicative of the ink level in ink container 12. In a preferred embodiment, the printing system provides a "low ink warning" when the sixth coarse ink level bit is set. Also in a preferred embodiment, the printing system sets the eight (last) coarse ink level bit when the ink container 12 is substantially depleted of ink. This last coarse ink level bit is referred to as an "ink out" bit. Upon querying the coarse ink level bits, the printing system interprets a "latched down" ink out bit as an "ink out" condition for ink container 12.

The volume is sensed by the inductive sensor coils 36 (FIG. 12) only during a second phase of ink usage. During the first phase, both fine and coarse counters of are used. Ink drops are counted and recorded in the fine counter portion of memory device 34. Each time the fine counter fully increments or decrements, another coarse counter bit will be set. During the second phase, only the ink level sensor coils 36 are used. The voltage output from the receiving coil 36 and is compared with the voltage level indicated by the parameter recorded on memory device 34. A parameter indicative voltage output is recorded on the write/erase portion of memory. Each successive reading is compared with the previous reading as an error checking technique to allow detection of coil malfunction.

At the start of the third phase, the fine counter is reset and used in the same manner as during the first phase. When the final coarse counter bit is set, an "ink out" warning will be indicated to the printing system. The three-phase arrangement is provided because inductive sensor coils 36 are sufficiently accurate only in the second phase.

In printing system 10, the transfer of data between printing system 10 and memory device 34 is in serial fashion on the single data line relative to ground. As explained above, while the ink in ink container 12 is being depleted, memory device 34 stores data that is indicative of its initial and current states. Printing system 10 updates memory device 34 to indicate the volume of ink remaining. When most or substantially all of the deliverable ink has been depleted, printing system 10 alters memory device 34 to allow ink container 12 to provide an "ink out" signal. Printing system 10 may respond by stopping printing with ink container 12. At that point, the user will insert a new ink container 12.

Figure 15:
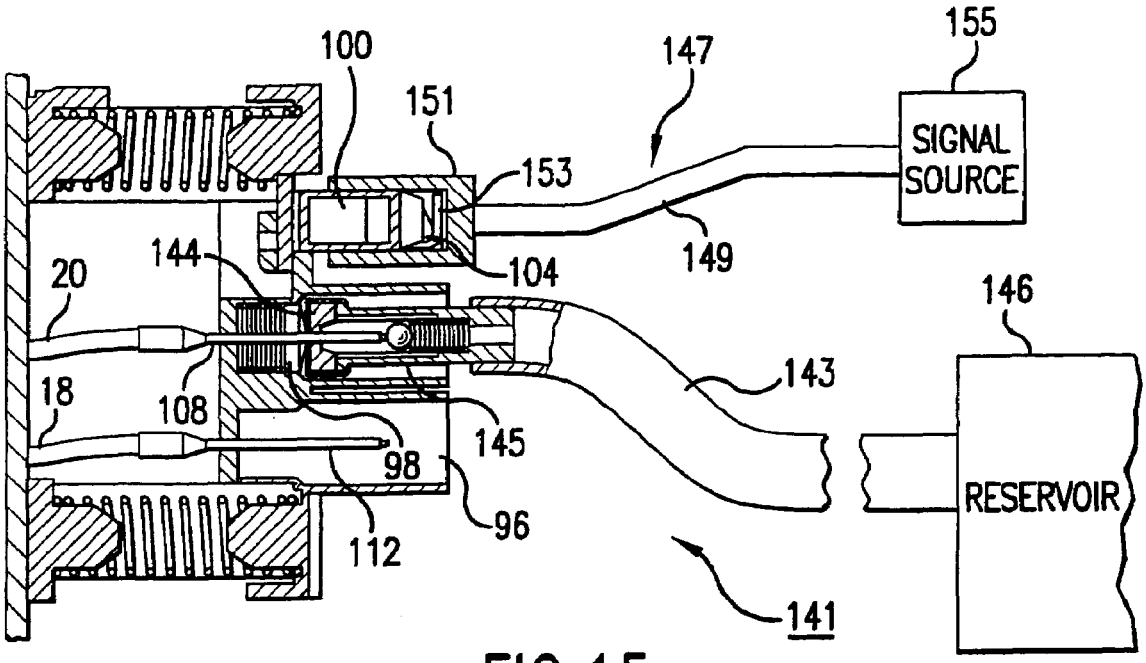
FIG. 15 is a side view of a first embodiment of an adaptive ink delivery system constructed in accordance with this invention.

Referring to FIG. 15, a first embodiment of an adaptive large volume ink supply 141 for replacing ink container 12 is shown. Ink supply 141 comprises a fluid conduit 143 such as a flexible tube that fluidically connects a fluid outlet 145 on one end of conduit 143 to an ink reservoir 146 on the other end of conduit 143. Conduit 143 allows reservoir 146 to be remotely located from receptacle 88 while fluid outlet 145 is connected to printing system 10. Locating reservoir 146 remotely from receptacle 88 allows reservoir 146 to be sized larger than the space constraints of receptacle 88 would allow. Fluid outlet 145 functions similarly to fluid outlet 30 discussed with respect to FIG. 12. In a preferred embodiment, fluid outlet 145 contains a septum 144 and is sized to connect to fluid inlet 98 (FIG. 10B). Hollow needle 108 pierces septum 144. The opposite end of conduit 143 is secured to ink reservoir 146. In the embodiment shown, air pressure from air outlet 96 is not utilized to force ink from reservoir 146.

Ink supply 141 also comprises an electrical ink supply circuit 147. Ink supply circuit 147 comprises a flexible electrical cable 149 with an adapter connector 151 on one end. Adapter connector 151 is provided for electrically connecting a signal source 155 to electrical connector 100 of printing system 10. Adapter connector 151 is configured to closely receive at least two opposite sides of electrical interconnect 100 (see also FIG. 9) to retain adapter connector 151. Adapter connector 151 may have a guide member similar to guide member 72 (FIGS. 5 and 6) which engages guide slot 106 (FIG. 9).

Adapter connector 151 has a plurality of flat contact pads 153 arrayed in a row for engaging electrical contacts 104 of connector 100. In a preferred embodiment, number and spacing of contact pads 153 are substantially the same as those described with respect to FIG. 5. Even if inductive volume sensing is not employed, preferably at least one pair of contacts would be positioned similar to contacts 78 in FIG. 5 and electrically connected together to enable controller 32 (FIG. 1) to perform a continuity check.

Ink supply circuit 147 is connected to the source of electrical signals 155 for supplying enabling information to printing system 10. A cable 149 enables electrical signal source 155 to be remote from receptacle 88 while adapter connector 151 is in engagement with contacts 104 of printing system 10. Alternatively, signal source 155 may be connected to cable 149 with a pluggable connector (not shown).

Electrical signal source 155 may be a memory circuit substantially the same as memory circuit 34 (FIG. 3) of the first embodiment. Alternately, signal source 155 may be an emulation device, which is an electronic circuit that functions similar to memory device 34 but may have a substantially different structure. As an emulation device, signal source 155 may exchange substantially the same type of information with printing system 10 (FIG. 1) as memory device 34. For example, as an emulation device, signal source 155 may provide information to controller 32 (FIG. 1) regarding the volume of ink, the type of ink and color when connector 151 is connected to electrical connector 100. These signals may be interpreted by controller 32 to be indicative of the initial ink supply size, the coarse ink level and the fine ink level. Each time the signal indicative of the fine ink level reaches an extreme, the coarse ink level signal may be incremented in signal source 155 in response. Thus an emulation device as signal source 155 may function as a duplicate or near duplicate of memory device 34. Alternatively, signal source 155 may be a signal-providing circuit that merely enables printing system 10 to operate whenever a new ink supply is provided but does not provide information concerning the volume of ink in reservoir 146 during usage.

In operation, ink supply 141 delivers ink similarly to ink container 12. The large volume ink reservoir 146 is connected to fluid inlet 98 through conduit 143 and fluid outlet 145. The seal of fluid outlet 145 is pierced by needle 108 of fluid inlet 98. Signal source 155 is connected to system connector 100 through ink supply connector 151 and cable 149. Ink is delivered from the ink reservoir while the remaining volume or other ink parameters are communicated to printing system 10 through ink supply circuit 147. Conduit 143 and cable 149 allow reservoir 146 and signal source 155, respectively, to be located remotely from printing system 10.

Figure 16:
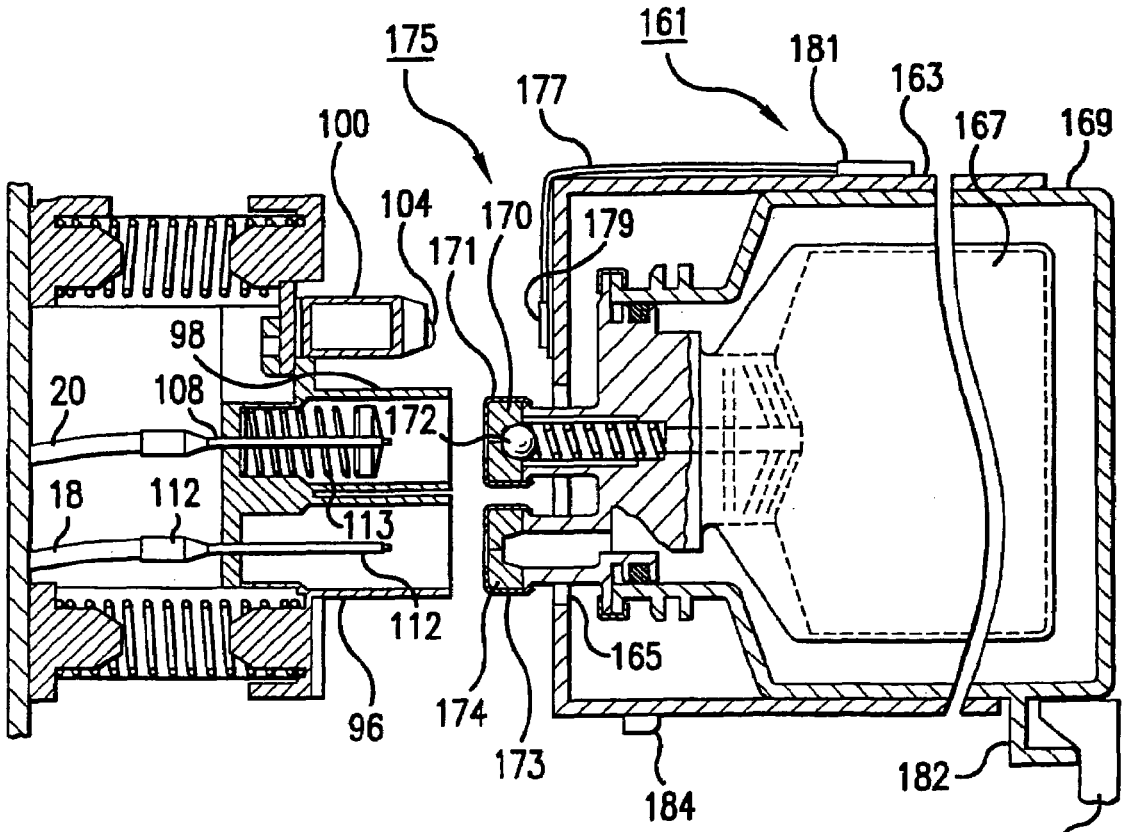
FIG. 16 is a side view of another embodiment of an adaptive ink delivery system constructed in accordance with this invention

Referring to FIG. 16, a second embodiment of an adaptive ink supply 161 for replacing ink container 12 is depicted. Ink supply 161 comprises a housing 163 with a leading end and a trailing end relative to a direction of installation of ink supply 161 into receptacle 88 (FIG. 8). In this figure, only features that pertain to the invention are shown. Housing 163 is sized to be inserted at least partially into receptacle 88 (FIG. 7). Housing 163 includes an opening 165 at the leading end for allowing the establishment of fluidic and air connections between ink supply 161 and the printing system 10. In a preferred embodiment, housing 163 includes keying and aligning features 184 that function similarly to keying and aligning features 58 and 60 discussed with respect to ink container 12.

A flexible ink reservoir 167 located within a rigid shell 169 is located inside housing 163. An fluid outlet 171 extending from reservoir 167 engages fluid inlet 98 and receives hollow needle 108 therein in a manner similar to that of fluid outlet 30 discussed with respect to ink container 12. In a preferred embodiment, a check valve 172 is located between reservoir 167 and fluid outlet 171 and is opened by needle 108 when the needle pierces a seal or septum 170 in fluid outlet 171. Shell 169 has an air inlet 173 with a septum 174 which connects to air outlet 96 and is pierced by the hollow needle 112 therein for delivering pressurized air from air outlet 96 to the pressure chamber in shell 169 for pressurizing reservoir 167. Fluid outlet 171 and air inlet 173 protrude through opening 165 in housing 163. Preferably, a volume sensing circuit comprising inductive coils is also used similar to that shown in FIG. 13.

In a preferred embodiment, ink supply 161 includes a latching feature 182 that allows ink supply 161 to be secured in receptacle 88 to assure a reliable fluidic, air, and electrical connections between ink supply 161 and printing system 10. In a preferred embodiment, the latching feature is an ink container latch feature 182 that is attached near the trailing end of shell 169 (as illustrated with respect to FIG. 16) or housing 163. Latch feature 182 is positioned on a lower side of ink supply 161 relative to a gravitational frame of reference. Latch feature 182 is positioned to engage latching portion 94 (discussed with respect to FIGS. 7 and 8) associated with receptacle 88. Latch feature 182 forms an opening for receiving latching portion 94.

Ink supply 161 also comprises an electrical ink supply circuit 175. In an exemplary embodiment, ink supply circuit 175 comprises a flexible electrical cable 177 extending from electrical contact pads 179 mounted to a leading end of housing 163. Although not shown, an alignment device similar to guide member 72 (FIGS. 5 and 6) may protrude from the leading end of housing 163 to assure proper alignment between contacts pads 179 and contacts 104 that protrude from connector 100. The alignment device generates movement of connector 100 in a direction perpendicular to the direction of insertion of ink supply 161 into printing system 10 in a manner similar to alignment feature 72 discussed with respect to ink container 12. The trailing end of housing 163 is open for allowing shell 169 to slide in and out of housing 163. Ink supply circuit 175 is provided for electrically coupling a source of signals 181 to electrical connector 100 of printing system 10.

Ink supply circuitry 175 also has the signal source 181 which may be an electrical memory device or an emulator for supplying enabling information to printing system 10. In an exemplary embodiment, signal source 181 is mounted to one side of housing 163. Housing 163 preferably has keying and guiding features 184 for functioning in a similar manner to items 58 and 60 (FIG. 3).

An alternative embodiment of the system described with respect to FIG. 16 would include a memory device 34 mounted to housing 163 in a manner similar to that discussed with respect to FIG. 5.

In operation, ink supply 161 operates similarly to ink container 12. The ink reservoir 167 is connected to fluid inlet 98 through fluid outlet 171. Pressure vessel. 169 is connected to air outlet 96 through air inlet 173. Signal source 181 is coupled to system connector 100 through ink supply connector contacts 179 and cable 177. A continuity check will be made by controller 32 once housing 169 is installed. Preferably this is made through one pair of volume sensing contacts similar to contacts 78 (FIG. 5) and at least one inductive coil similar to coil 36 shown in FIG. 13. Ink is delivered to printing system 10 as pressurized air flows to shell 169 to apply pressure to reservoir 167. The operating parameters of ink supply 161 may be communicated to printing system 10 as described above for ink supply 141.

When ink supply 161 is releasably installed into receptacle 88 such that fluid, air, and electrical connections are established between ink supply 161 and printing system 10, springs 101 are compressed. Springs 101 exert a force on ink supply 161 that is directed opposite to the direction of installation. If necessary, ink supply 161 includes at least one latching feature 184 to that exerts an opposing force directed along the direction of installation.

When ink is depleted from reservoir 167, there are several options. Reservoir 167 and shell 169 may be removed from housing 163 and replaced by another reservoir and shell. Alternately, reservoir 167 may be refilled. In both cases, if signal source 181 provides volume information, it will need to be updated in some manner so as to not supply erroneous information to printing system controller 32 (FIG. 1).

Figure 17:
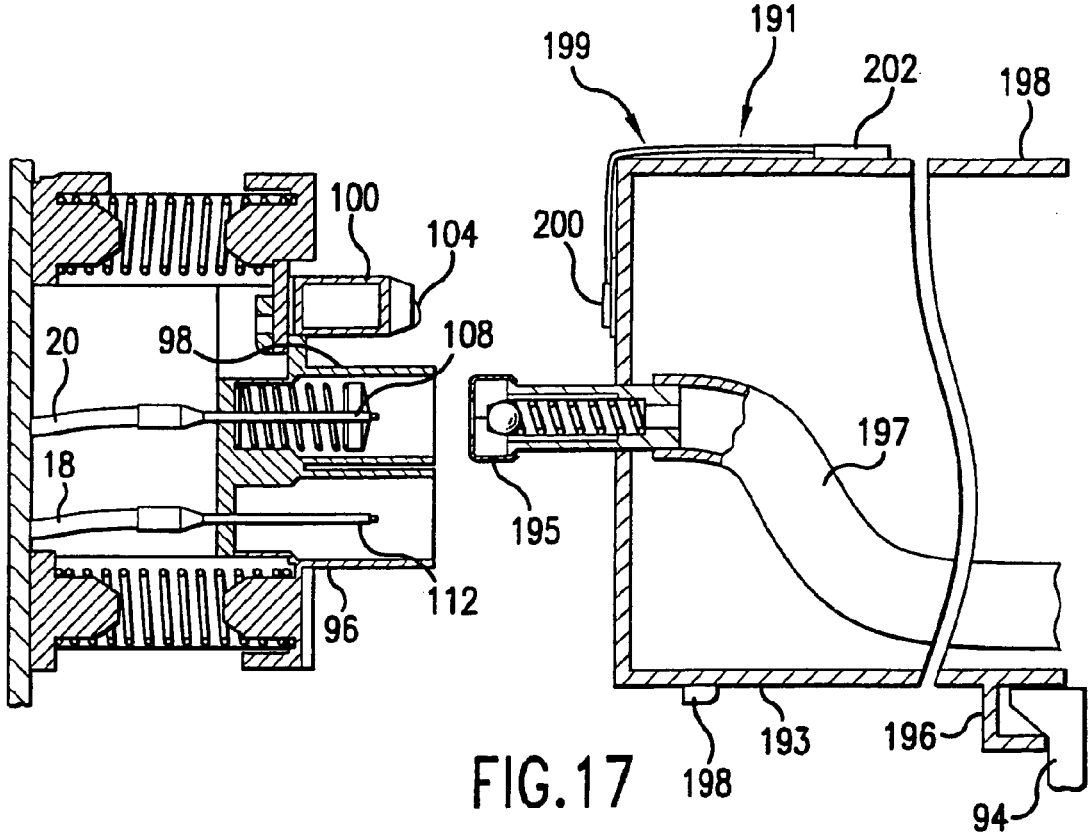
FIG. 17 is a side view of another embodiment of an adaptive ink delivery system constructed in accordance with this invention.

A third embodiment of an adaptive ink supply is depicted in FIG. 17. Ink supply 191 comprises a housing 193 having leading and trailing ends relative to a direction of instllation of housing 193 into receptacle 88. Housing 193 includes a fluid outlet 195 secured to and protruding from the leading end. Housing 193 contains an ink conduit 197 that extends from outlet 195 to an ink reservoir (not shown). In an exemplary embodiment, the reservoir (not shown) is remote from housing 193 similar to reservoir 146 in FIG. 15. This remote configuration allows the use of ink supplies that would not fit in receptacle 88. Fluid outlet 195 extends laterally from housing 193 and engages fluid inlet 98 in a manner similar to the function of fluid outlet 30 discussed with respect to ink container 12. Ink supply 191 has an electrical ink supply circuit 199 which may be similar to circuit 175 discussed with respect to FIG. 16, having a plurality of contacts such as flat contact pads 200 on a leading end of housing 193 and connected to a signal source 202 by a plurality of conductive leads.

In a preferred embodiment, ink supply 191 includes a latching feature 196 that allows ink supply 191 to be secured in receptacle 88 to assure a reliable fluidic and electrical connections between ink supply 191 and printing system 10. Latch feature 196 is positioned to engage latching portion 94 associated with receptacle 88. Latch feature extends downwardly from a trailing end of housing 193 relative to a gravitational frame of reference. Other means of providing a latch feature are possible, including surfaces on housing 193 that provide a friction fit between housing 193 and the sides of receptacle 88.

In a preferred embodiment, housing 193 also includes keying and aligning features 198 that are preferably similar to the keying and aligning features 58 and 60 discussed with respect to FIG. 3. When housing 193 is releasably inserted into receptacle 88, the keying and aligning features 198 provide coarse alignment between housing 193 and receptacle 88. This allows fluid outlet 195 to properly engage sleeve 110 associated with fluid inlet 98 to allow needle 108 to properly align to and be received by fluid outlet 195. The fluidic connection between needle 108 and inlet fluid outlet 195 provides an intermediate level of alignment accuracy between connector 100 and pads 200. An alignment member such as upstanding member 72 is then used to provide fine alignment between pads 200 and contacts 104. This coarse, intermediate, and fine alignment scheme is similar to that discussed for ink container 12 with respect to FIGS. 10A and 10B.

In operation, when housing 193 is inserted into a receptacle 88 (FIG. 7), fluid outlet 195 connects to fluid inlet 98. Signal source 202 in ink supply connector 199 is coupled to system connector 100 through contact pads 200. In a preferred embodiment, an electrical continuity check is performed as described with respect to FIG. 15. Ink is delivered to printing system 10 through fluid outlet 195. Signal source 202 exchanges information with controller 32 (FIG. 1) as described above.

When ink supply 191 is releasably installed into receptacle 88 such that fluid and electrical connections are established between ink supply 191 and printing system 10, springs 101 are compressed. Springs 101 exert a force on ink supply 191 that is directed opposite to the direction of installation. If necessary, ink supply 191 includes at least one latching feature 196 to overcome this force, as discussed earlier.

Figure 18:
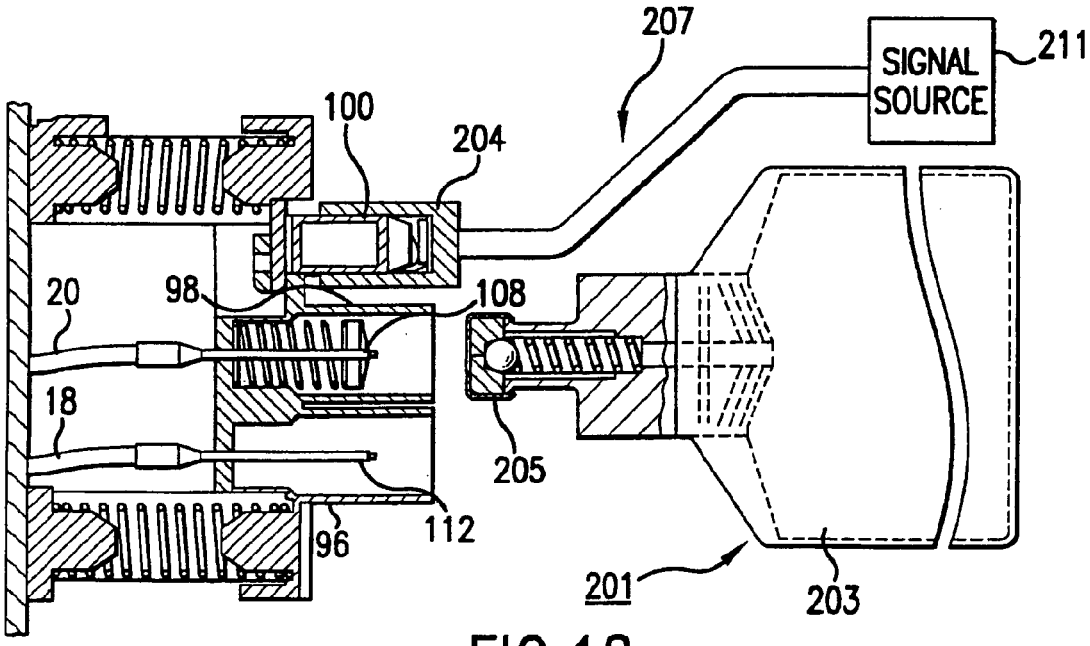
FIG. 18 is a side view of another embodiment of an adaptive ink delivery system constructed in accordance with this invention.

FIG. 18 depicts a fourth embodiment of the invention. Ink supply 201 has an ink reservoir 203 with a fluid outlet 205 protruding from one end. Volume sensing circuitry such as coils 36 (FIG. 13) can also be employed on reservoir 203. An electrical ink supply circuit 207 is employed which maybe the similar to ink supply circuit 147 of ink supply 141 as described with respect to FIG. 15. Ink supply circuit 207 has an electrical connector 204 which connects to a signal source 211. In operation, ink is metered from reservoir 203 as signal source 211 electronically exchanges information with controller 32 of printing system 10 (FIG. 1). Electrical continuity may be checked as described in connection with FIG. 15. Electrical signal source 211 may be similar to memory device 34 or it may be an emulator that is functionally equivalent to the memory device 34.

Figure 19:
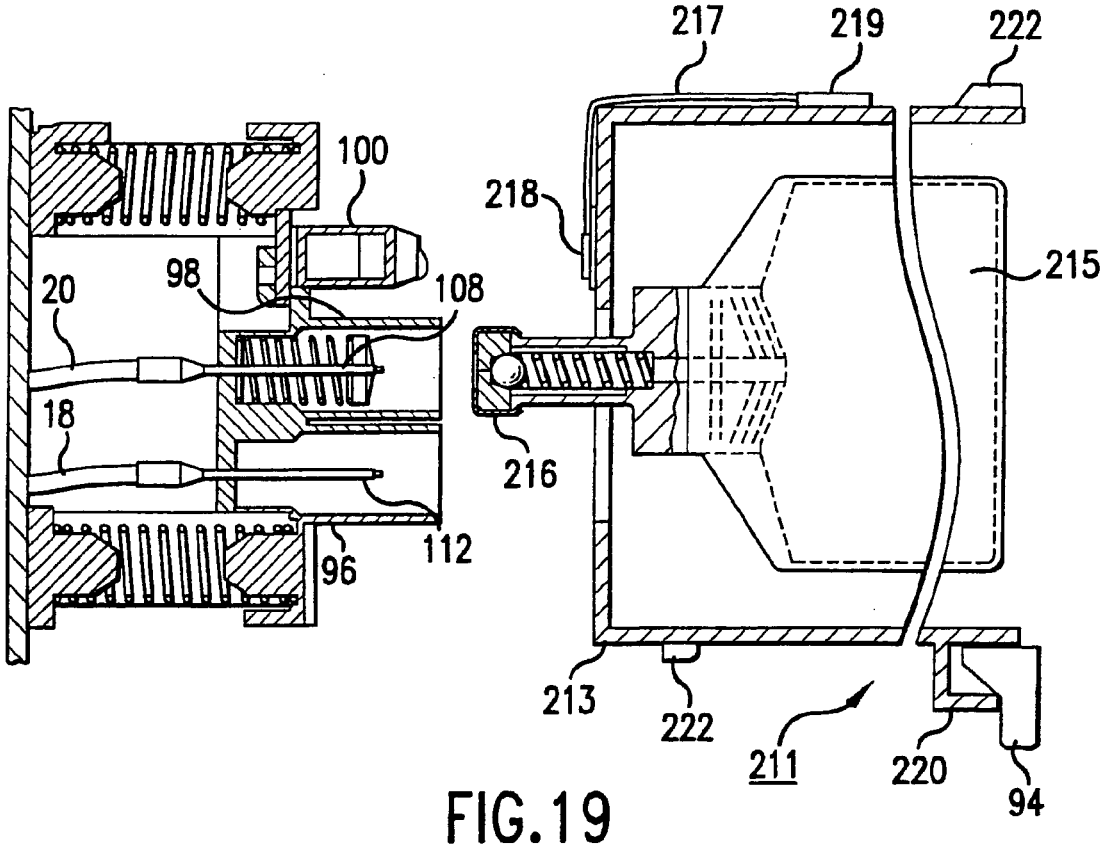
FIG. 19 is a side view of another embodiment of an adaptive ink delivery system constructed in accordance with this invention.

A fifth embodiment of an adaptive ink delivery system is shown in FIG. 19. Ink supply 211 has an external housing 213 that contains an ink reservoir 215 that has an fluid outlet 216. Housing 213 has an open trailing end for slidingly receiving reservoir 215. An electrical ink supply circuit 217 is mounted to housing 213 and may be the same as ink supply circuit 199, described above in connection with FIG. 17. Ink supply circuit 217 has contact pads 218 mounted to a leading end of housing 213 and a signal source 219 mounted to the side of housing 213. Ink supply 211 operates similarly to ink supply 201 as described with respect to FIG. 18.

An alternative embodiment of the system described with respect to FIG. 19 would include a memory device 34 mounted to housing 213 in a manner similar to that discussed with respect to FIG. 5.

When ink supply 211 is releasably installed into receptacle 88 such that fluid and electrical connections are established between ink supply 211 and printing system 10, springs 101 are compressed. Springs 101 exert a force on ink supply 191 that is directed opposite to the direction of installation. If necessary, ink supply 211 includes at least one latching feature 220 to overcome this force, such as a latch feature located on the trailing end of housing 213. In a preferred embodiment, ink supply 211 includes keying and aligning features 222 that function similarly to the keying and aligning features 58 and 60 discussed with respect to ink container 12.

Figure 20:
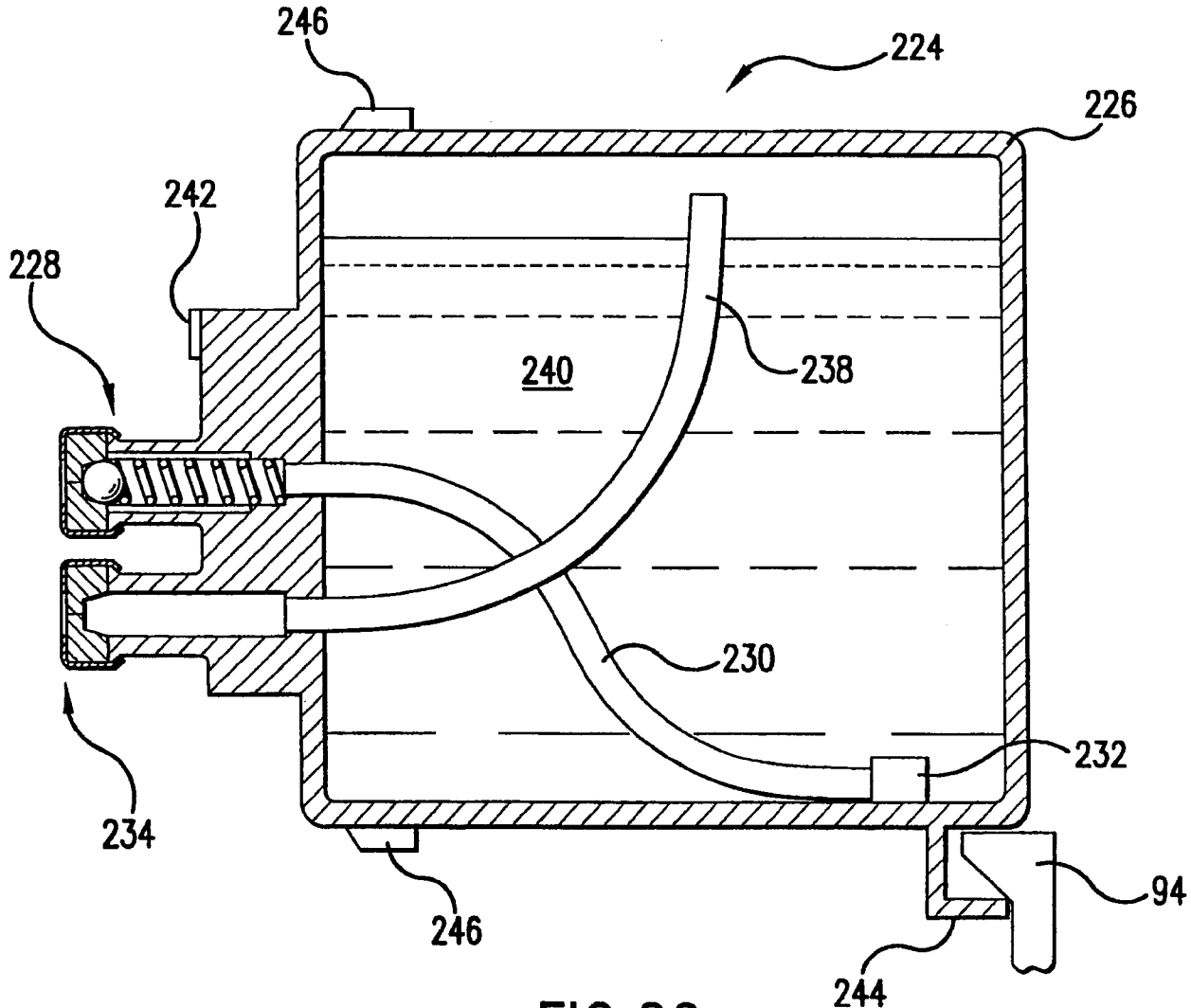
FIG. 20 is a side view of another embodiment of an adaptive ink delivery system constructed in accordance with this invention.

FIG. 20 depicts an ink supply 224 that uses a rigid ink reservoir 226. Reservoir 226 has a fluid outlet 228 that is configured similar to the fluid outlets previously described for fluidic connection to fluid inlet 98 (FIG. 19). An ink conduit 230 extends into reservoir 226 and terminates at the bottom with a filter 232. Filter 232 is preferably of a type that will allow the passage of ink into ink tube 230, but block air flow into tube 230. An air inlet 234 is located next to fluid outlet 228 for reception into air outlet 96 (FIG. 19). Air inlet 234 is connected to an air tube 238 that extends into an upper side of reservoir 226. A memory or emulator unit and electrical contact pads 242 are located on a leading edge of reservoir 226. Contact pads 242 are positioned to engage printer electrical connector 100 (FIG. 19). A guide member (not shown) such as guide member 72 (FIG. 5) will be employed.

In a preferred embodiment, ink supply 224 includes latch feature 244 for engaging latch portion 94 associated with printing system 10. This latch feature would be similar to and function similarly to the latch feature 62 described with respect to FIGS. 3–10.

In a preferred embodiment, ink supply 224 includes keying and aligning features 246 that would be similar to and function similarly to the keying and aligning features 58 and 60 discussed with respect to FIGS. 3–10.

In use, reservoir 226 inserts into receiving slot 88 (FIG. 8), with fluid outlet 228 engaging fluid inlet 98, air inlet 234 engaging air outlet 96, and contact pads 242 engaging electrical connector 100. Air pressure is delivered from the printer compressor 16 (FIG. 1). The air pressure is applied to the interior of reservoir 226 above ink 240. This pressurizes ink 240 that then flows through filter 232 and conduit 230 to the printhead 14 (FIG. 1).

Each of the foregoing electrical circuits 147, 161, 199, 207 and 217 are preferably provided with an alignment or upstanding guide member similar to guide member 72 (FIGS. 5 and 6). Guide member 72 is located adjacent to the contact pads of the respective electrical connectors for engaging one of the sides of support member 100 to align the contact pads with those of printing system 10.

Figure 21:
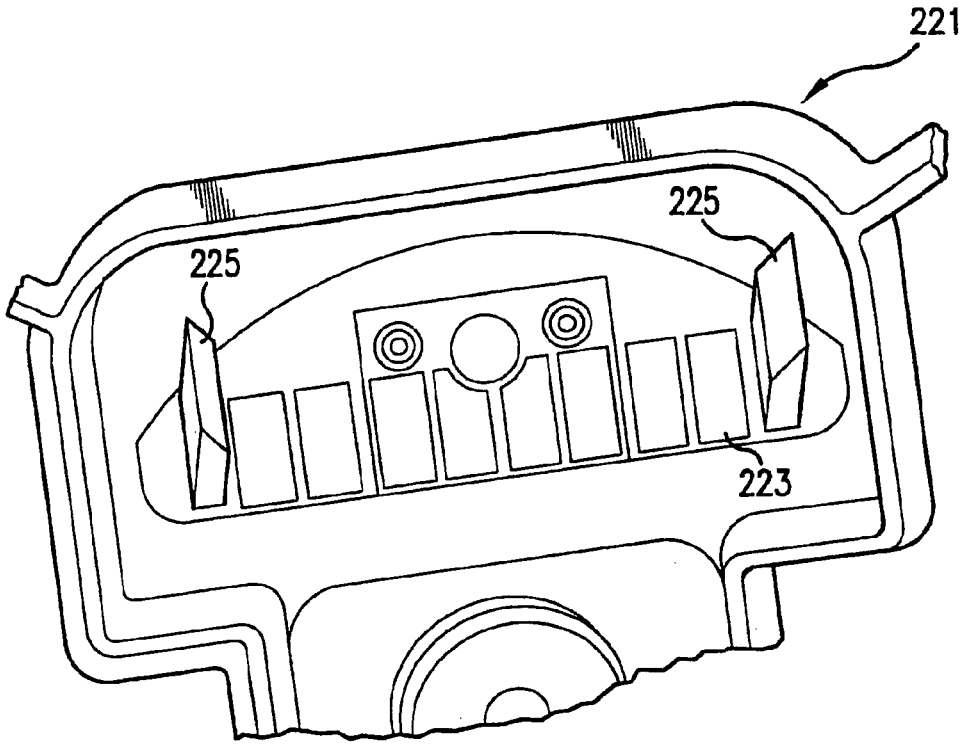
FIG. 21 is an enlarged proximal end view of an ink container showing another embodiment of the electrical contacts.
Figure 22:
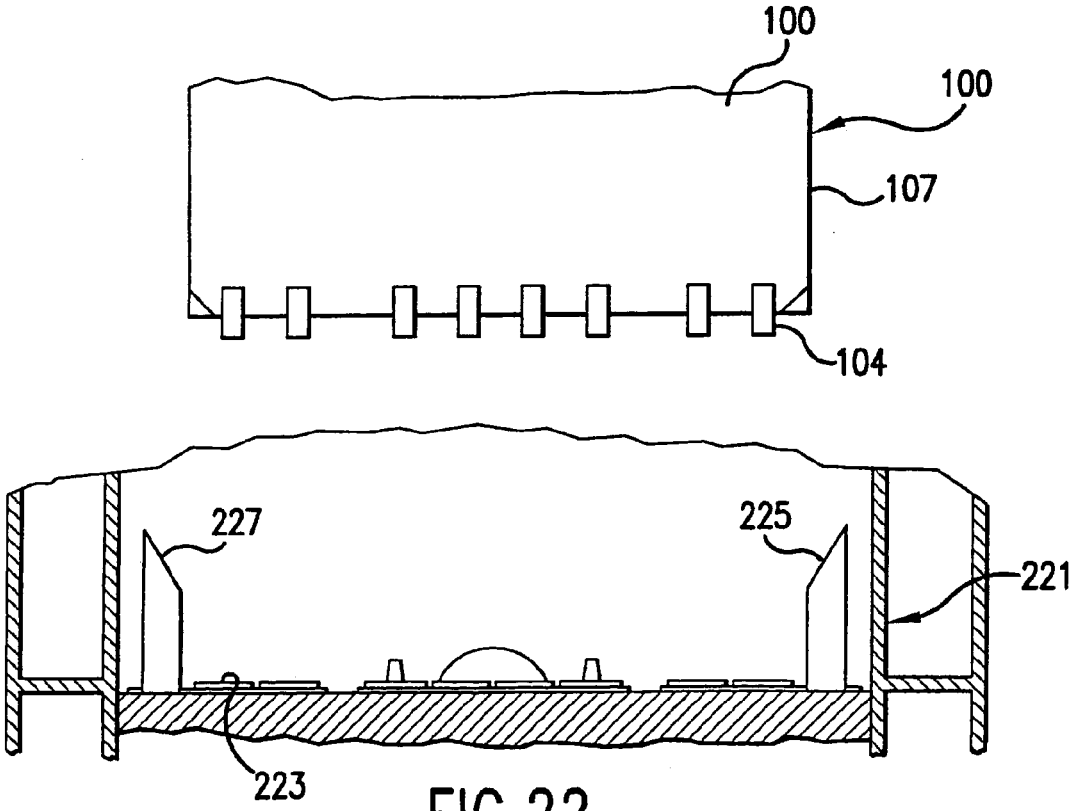
FIG. 22 is an enlarged sectional view of the ink container of FIG. 21 shown in alignment with the electrical interconnect portion.

An alternate embodiment for guide member 72 of ink supply connectors 147, 161, 199, 207 and 217 is shown in FIGS. 21 and 22. A connector 221 having a row of contact pads 223 for engaging contacts 104 of connector 100 is provided with a pair of spaced-apart alignment members 225. One alignment member 225 is located adjacent each of the outermost contact pads 223. Alignment members 225 have inclined surfaces 227 for engaging opposite lateral sides 107 of support member 100 for facilitating the joining of connectors 100 and 221, and the proper alignment of contacts 223 and 104.

The invention has several advantages. Some ink delivery systems described, such as those described with respect to FIGS. 15 and 17 allow for large ink reservoirs that cannot be accommodated in receiving slot 88. This allows users who require high usage to replace the ink containers less frequently. On the other hand, systems such as those described with respect to FIGS. 15, 16, 18, and 19, allow the ink reservoir portion of the ink supply to be replaced separately from the electronic portion. If desired for lower use rates, a plurality of relatively small reservoir portions can be utilized for each electronic portion.

While the invention has been shown or described in only some of its forms, it should be apparent to those skilled in the art that it is not so limited, but is susceptible to various changes without departing from the scope of the invention.

What is claimed is:

1. An emulator for use in a printing system, the printing system having a controller and being configured to receive a replaceable ink container having replacement ink therein and replacement ink information associated therewith, the replaceable ink container without a memory device attached thereto for storing the replacement ink information, the emulator comprising:

an electrical signal source separate from and not coupled to the replaceable ink container for storing and exchanging the replacement ink information with the controller, wherein the electrical signal source is a signal-providing circuit that enables the printing system to operate whenever the replaceable ink container is fluidically coupled to the printing system; and a flexible cable operatively coupled to the electrical signal source and configured to separably electrically connect to the controller.

2. The emulator of claim 1, wherein the replaceable ink container is a refilled ink container containing the replacement ink different from the initial ink and wherein the electrical signal source includes the replacement ink information the printing system interprets as an ink volume associated with the replacement ink.

3. The emulator of claim 1, further comprising a replaceable ink reservoir containing the replacement ink, the replaceable ink reservoir remotely located from the electrical signal source.

4. A replacement source of signals for a printing system, the printing system having a receptacle for receiving a first ink supply, a controller which exchanges first ink supply information with a first memory device coupled to the first ink supply, and an ink supply inlet fluidically connected to a printhead, the replacement source of signals comprising:

an electrical signal source for exchanging replacement ink supply information about a replacement ink supply with the controller, the replacement ink supply information exchanged with the controller in place of first ink supply information from the first memory device, wherein the electrical signal source is separate from and not coupled to the replacement ink supply; and a connector for separably electrically connecting the electrical signal source to the controller.

5. The replacement source of signals of claim 4, wherein the replacement ink supply information exchanged by the electrical signal source includes information regarding a volume of the replacement ink supply.

6. The replacement source of signals of claim 4, wherein the electrical signal source contains a second memory device which has a write portion which is adapted to be updated by the controller to provide an estimate of a volume of the replacement ink supply during usage of the replacement ink supply by the printing system.

7. The replacement source of signals of claim 4, further comprising a flexible cable electrically connecting the connector and the electrical signal source.

8. The replacement source of signals of claim 4, further comprising a fluid outlet in fluid communication with the replacement ink supply.

9. The replacement source of signals of claim 8, wherein the fluid outlet is adapted to be received by the ink supply inlet.

10. The replacement source of signals of claim 8, wherein the fluid outlet is remotely located from the ink supply inlet.

11. The replacement source of signals of claim 10, wherein the fluid outlet is fluidically connected to the ink supply inlet via a flexible fluid conduit.

12. The replacement source of signals of claim 4, wherein the electrical signal source is remotely located from the replacement ink supply.

* * * * *

UNITED STATES PATENT AND TRADEMARK OFFICE

CERTIFICATE OF CORRECTION

PATENT NO. : 7,188,918 B2
APPLICATION NO. : 10/634024
DATED : March 13, 2007
INVENTOR(S) : Winthrop D. Childers et al.

It is certified that error appears in the above-identified patent and that said Letters Patent is hereby corrected as shown below:

In column 5, line 1, after "50" insert -- so --.

In column 13, line 40, delete "instllation" and insert -- installation --, therefor.

In column 14, line 10, after "108 and" delete "inlet".

Signed and Sealed this

Second Day of December, 2008

JON W. DUDAS
*Director of the United States Patent and Trademark Office*